US010583673B2

(12) United States Patent
Inoue et al.

(10) Patent No.: US 10,583,673 B2
(45) Date of Patent: Mar. 10, 2020

(54) PRINTING APPARATUS, PRINTING METHOD AND COMPUTER-READABLE MEDIUM

(71) Applicant: Brother Kogyo Kabushiki Kaisha, Nagoya-shi, Aichi-ken (JP)

(72) Inventors: Naoki Inoue, Nagoya (JP); Kazuma Hojo, Inazawa (JP); Ryohei Nakagawa, Nagoya (JP); Takuya Kanda, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 16/131,090

(22) Filed: Sep. 14, 2018

(65) Prior Publication Data

US 2019/0299676 A1 Oct. 3, 2019

(30) Foreign Application Priority Data

Mar. 30, 2018 (JP) ..... 2018-066689

(51) Int. Cl.
*B41J 11/04* (2006.01)
*B41J 13/03* (2006.01)
*B41J 11/42* (2006.01)

(52) U.S. Cl.
CPC ..... *B41J 13/03* (2013.01); *B41J 11/04* (2013.01); *B41J 11/42* (2013.01)

(58) Field of Classification Search
CPC ..... B41J 11/04; B41J 11/42; B41J 13/03
See application file for complete search history.

(56) References Cited

U.S. PATENT DOCUMENTS 8,454,251 B2 * 6/2013 Bhatia ..... B41J 15/04 400/149
10,105,973 B1 * 10/2018 Hojo ..... B41J 13/0009

FOREIGN PATENT DOCUMENTS

JP 2015-199205 A 11/2015

* cited by examiner

*Primary Examiner* — Lamson D Nguyen
(74) *Attorney, Agent, or Firm* — Banner & Witcoff, Ltd.

(57) ABSTRACT

A printing apparatus includes: a frame; a platen roller configured to be rotated; a movable body supported by the frame, to be movable in a first direction and a second direction; an AC motor provided on the frame; a transmission device provided on the frame, transmitting driving force of the AC motor to the movable body, moving the movable body in the first direction in accordance with rotation of the AC motor toward one side, and including at least an electromagnetic clutch; an encoder outputting a rotation signal in accordance with a rotation amount of the platen roller; and a controller. The controller starts the rotation of the AC motor toward the one side, determines whether the rotation amount of the platen roller in accordance with the rotation signal is not more than a predetermined value, and allows the electromagnetic clutch to be in a connected state.

8 Claims, 16 Drawing Sheets

PRINTING APPARATUS, PRINTING METHOD AND COMPUTER-READABLE MEDIUM

CROSS REFERENCE TO RELATED APPLICATION

The present application claims priority from Japanese Patent Application No. 2018-066689 filed on Mar. 30, 2018 the disclosure of which is incorporated herein by reference in its entirety.

BACKGROUND

Field of the Invention

The present disclosure relates to a printing apparatus, a printing method and a computer-readable medium.

Description of the Related Art

There is known a printing apparatus configured to perform printing with respect to a print medium (packaging material, label, etc.) which is conveyed by a conveying apparatus such as a packaging machine, etc. Further, a technique for controlling a conveying velocity at a part or portion, of the print medium, at which printing by the printing apparatus is performed (hereinafter referred to as a "print position velocity") is also suggested.

Japanese Patent Application Laid-open No. 2015-199205 discloses a thermal printer which performs printing with respect to an elongated film conveyed by a bag form-fill-sealing machine. The thermal printer is provided with a platen roller, a pinch roller, a pair of moving rollers (also referred to as a "moving mechanism"), and a sensor. The platen roller is connected to a motor via a clutch. In a case that the thermal printer does not perform the printing with respect to the elongated film, the thermal printer stops the motor and allows the clutch to be in a non-connected state. On the other hand, in a case that the thermal printer perform the printing with respect to the elongated film, the thermal printer drives and rotates the motor and allows the clutch to be in a connected state, thereby rotating the platen roller, which in turn conveys the elongated film in a state that the elongated film is pinched between the pinch roller and the platen roller. While the printing is executed by the thermal printer, the moving mechanism is moved along a X direction either toward a X1 side or toward a X2 side, in accordance with a relationship between a conveying velocity of the elongated film by the bag form-fill-sealing machine and a conveying velocity of the elongated film by the rotation of the platen roller. With this, a conveying velocity at a location of the elongated film at which the elongated film makes contact with the platen roller is maintained at a constant (predetermined) printing velocity.

In a case that the printing is ended, the thermal printer stops the rotation of the motor while maintaining the clutch at the connected state. In this case, the moving mechanism is moved toward the X1 side in response to the decrease in the force toward the X2 side received from the elongated film which is being conveyed. The sensor detects that the moving mechanism is arranged at a reference position X0 which is a position at an end part on the X1 side in the X direction. In a case that the moving mechanism has moved up to the reference position X0, the thermal printer allows the clutch to be in the non-connected state. By doing so, the thermal printer causes the moving mechanism to stop at the reference position X0.

SUMMARY

In a case that an AC motor is used as the motor, there occurs a delay since a driving signal is outputted to the AC motor and until the AC motor starts to rotate. Accordingly, in addition to a time required since the AC motor starts rotating and until the AC motor accelerates to a desired rotation velocity (so-called "through-up time), this delay time also contributes to a time until the AC motor rotates at the desired rotation velocity. Thus, in a case, for example, that the time since the detection of the print signal up to a print start timing is short, and/or in a case that the interval or spacing distance between print images is short, there is such a possibility that the print position velocity of the print medium might not reach the predetermined printing velocity.

An object of the present teaching is to provide a printing apparatus, a printing method, a printing program and a computer-readable medium storing a printing program capable of lowering such a possibility that, in a case of controlling the print position velocity of the print medium with the AC motor, the printing velocity might not reach the predetermined printing velocity at the print start timing.

According to a first aspect of the present teaching, there is provided a printing apparatus including: a frame; a platen roller configured to be rotated around a first axis; a movable body supported by the frame to be movable in a first direction orthogonal to the first axis and a second direction opposite to the first direction, the movable body having: a first roller positioned upstream of the platen roller in a conveyance path of a print medium and a second roller positioned downstream of the platen roller in the conveyance path, and a supporting member rotatably supporting the first roller and the second roller, the movable body being configured to shorten a part, of the conveyance path, between the platen roller and the first roller in accordance with movement of the movable body in the first direction, and to lengthen the part, of the conveyance path, between the platen roller and the first roller in accordance with movement of the movable body in the second direction; an AC motor provided on the frame; a transmission device provided on the frame and configured to transmit a driving force of the AC motor to the movable body and configured to move the movable body in the first direction in accordance with rotation of the AC motor toward one side, the transmission device including at least an electromagnetic clutch, the transmission device being configured to transmit the driving force to the movable body in a case that the electromagnetic clutch is in a connected state, and configured not to transmit the driving force to the movable body in a case that the electromagnetic clutch is in a disconnected state; an encoder configured to output a rotation signal in accordance with a rotation amount of the platen roller; a communication interface configured to communicate with an external apparatus and to receive a print signal indicating a position of the recording medium; and a controller configured to: start the rotation of the AC motor toward the one side regardless of the rotation signal outputted from the encoder and the print signal received via the communication interface, determine whether the rotation amount of the platen roller in accordance with the rotation signal outputted from the encoder is equal to or less than a predetermined value, after staring the rotation of the AC motor toward the one side, and allow the electromagnetic clutch to be in the connected state, under a condition that the controller determines that the rotation amount is equal to or less than the predetermined value.

The printing apparatus starts the rotation of the AC motor, regardless of the rotation signal outputted from the encoder and the print signal received via the communication I/F. In a case that the printing apparatus determines that the rotation amount of the platen roller is equal to or less than the predetermined value, the printing apparatus allows the clutch to be in the connected state. In this case, the driving force of the AC motor is transmitted to the movable body, thereby moving the movable body in the first direction. With this, even if, for example, the conveyance velocity of the print medium which is conveyed by the external apparatus is lowered, the print position velocity is maintained. Here, since the clutch is allowed to be in the connected state in a state that the AC motor is continuously rotating toward the one side, the printing apparatus is capable of starting the movement of the movable body in the first direction at a desired timing. Accordingly, the printing apparatus is capable of controlling the print position velocity of the print medium, during the printing performed on the print medium, with an excellent precision, and is capable of performing printing at a desired position of the print medium.

According to a second aspect of the present teaching, there is provided a printing method including: a stating step of starting rotation of an AC motor toward one side; a first determining step of determining whether a rotation amount of a platen roller is equal to or less than a predetermined value, after starting the rotation of the AC motor toward the one side by the starting step; and a connecting step of connecting, in a case that the rotation amount is determined to be equal to or less than the predetermined value by the first determining step, an electromagnetic clutch which is included in a transmission device configured to transmit driving force from the AC motor, to thereby move a movable body in a first direction by the driving force which is generated by the rotation of the AC motor toward the one side and which is transmitted to the movable body via the transmission device, and to accelerate a print medium at a position of the platen roller. According to the second aspect, it is possible to realize an effect similar to that realized by the first aspect.

According to a third aspect of the present teaching, there is provided a non-transitory computer-readable medium storing computer-executable instructions which, when executed by a processor of a printing apparatus, cause the printing apparatus to execute: a starting step of starting rotation of an AC motor toward one side, the AC motor driving a movable body via a transmission device, the movable body being configured to accelerate a print medium at a position of a platen roller in accordance with movement of the movable body in a first direction; a first determining step of determining, after stating the rotation of the AC motor toward the one side by the starting step, whether a rotation amount of the platen roller is equal to or less than a predetermined value, based on a rotation signal which is outputted from an encoder in accordance with the rotation amount of the platen roller; and a connecting step of allowing, in a case that the rotation amount is determined to be equal to or less than the predetermined value by the first determining step, an electromagnetic clutch included in the transmission device to be in a connected state, wherein in a case that the electromagnetic clutch is allowed to be in a connected state, a driving force which is generated by the rotation of the AC motor toward the one side is transmitted to the movable body to thereby move the movable body in the first direction; and in a case that the electromagnetic clutch is allowed to be in a disconnected state, the driving force which is generated by the rotation of the AC motor toward the one side is not transmitted to the movable body and the movable body does not move in the first direction. According to the third aspect, it is possible to realize an effect similar to that realized by the first aspect.

DESCRIPTION OF THE EMBODIMENTS

Figure 2:
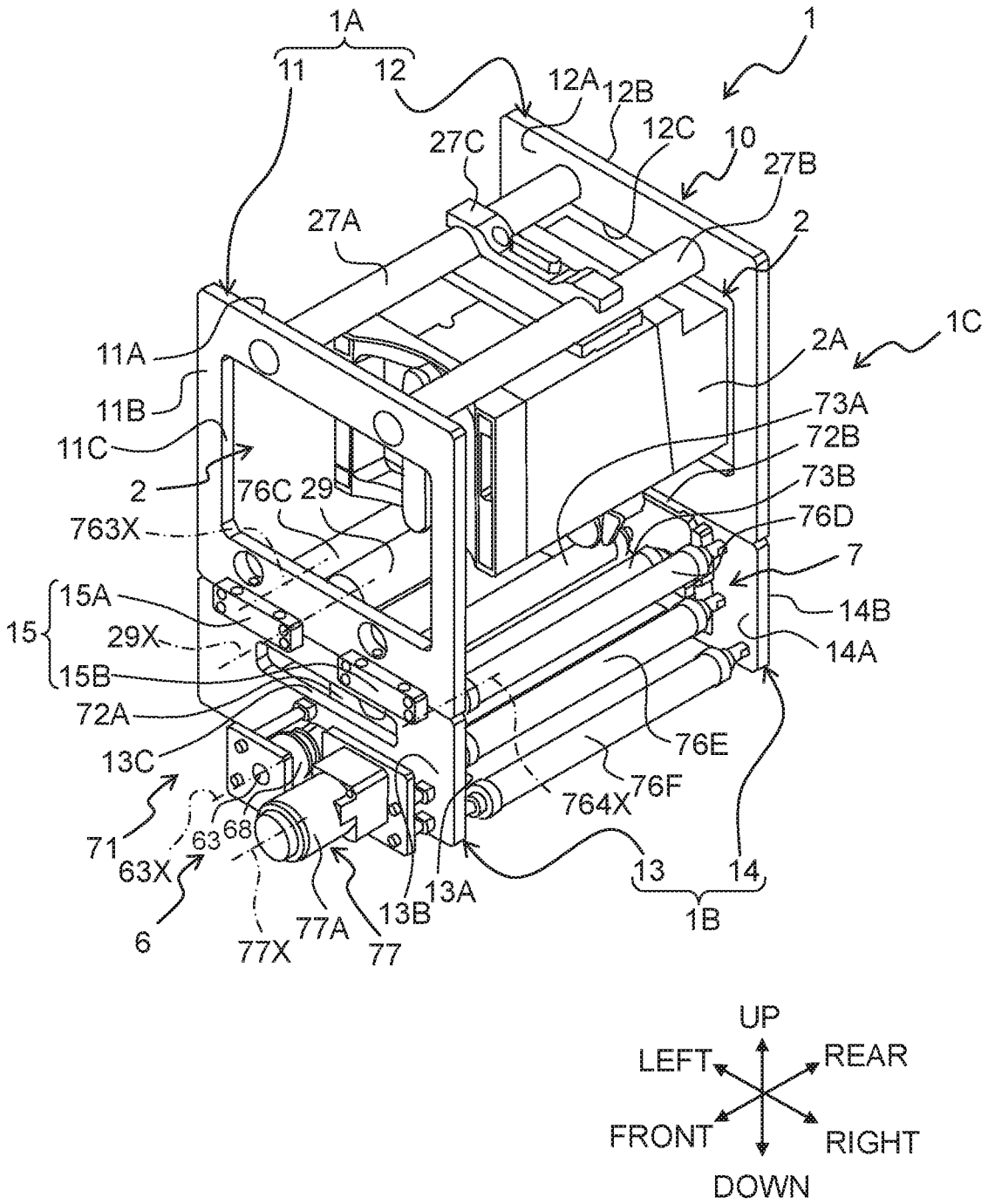
FIG. 2 is a perspective view of the printing apparatus as seen from a right obliquely front side thereof.

An embodiment of the present disclosure will be explained with reference to the drawings. A printing apparatus 1 is a printing apparatus of the thermal transfer type. In the following, the upper side, the lower side, the left side, the right side, the front side and the rear side of the printing apparatus 1 will be defined so that the explanation of the drawings will be easily understood. The upper side, the lower side, the left side, the right side, the front side and the rear side of the printing apparatus 1 correspond to the upper side, the lower side, the left obliquely upper side, the right obliquely lower side, the left obliquely lower side and the right obliquely upper side, respectively, as depicted in FIG. 2.

<General Configuration of Printing Apparatus 1>

Figure 1:
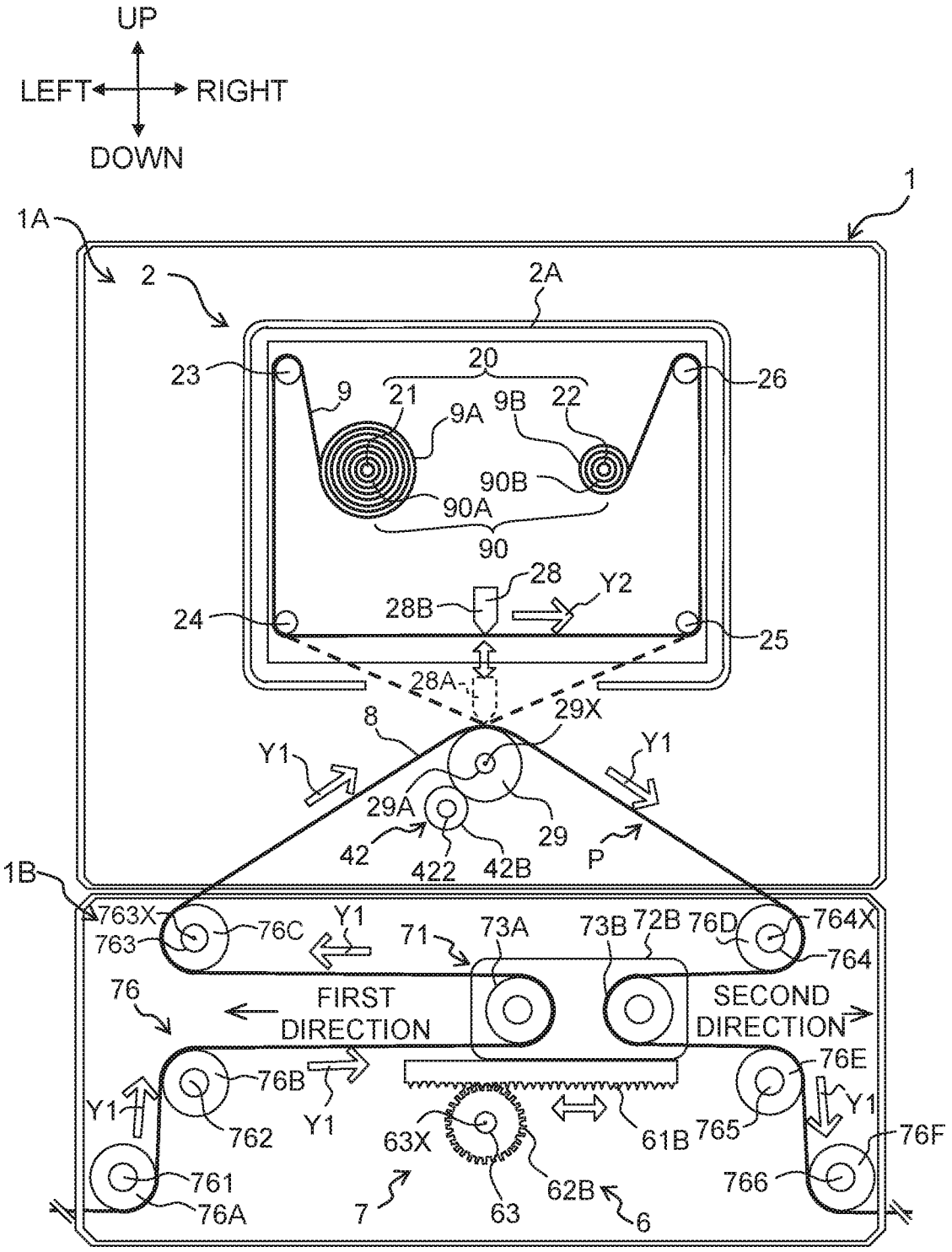
FIG. 1 is a view depicting the general configuration of a printing apparatus.

As depicted in FIG. 1, the printing apparatus 1 executes printing with respect to a print medium 8, which is conveyed by an external apparatus 100 (see FIGS. 12A and 12B), by heating an ink ribbon 9. The ink ribbon 9 is accommodated in a ribbon assembly 90 which is detachable/attachable with respect to a printing section 2 (to be described later on). The ink ribbon 9 in the ribbon assembly 90 is wound in a roll shape around each of a core shaft 90A which is connected to one end of the ink ribbon 90 and a core shaft 90B which is connected to the other end of the ink ribbon 90. The ink ribbon 9 wound in the roll shaped around each of the core shaft 90A and the core shaft 90B is referred to as "rolls 9A, 9B". The print medium 8 is conveyed by the external apparatus 100 at a predetermined conveying velocity (hereinafter referred to as a "conveyance position velocity"), and is supplied to a conveying section 7 (to be described later on). A specific example of the external apparatus 100 includes, for example, a packaging machine which conveys a packaging material. In this case, for example, the printing apparatus 1 is incorporated to a part of a conveyance line in which the print medium 8 is conveyed by the packaging machine.

The printing apparatus 1 has a printing section 2 and a conveying section 7. The printing section 2 is arranged at a position above the conveying section 7. The printing section 2 controls a printing function with respect to the print medium 8. More specifically, the printing section 2 presses the ink ribbon 9 against the print medium 8 by a thermal head 28 and a platen roller 29, while conveying the ink ribbon 9 in the ribbon assembly 90. The printing section 2 transfers an ink of the ink ribbon 9, which is being conveyed, to the print medium 8 by heating the thermal head 28 in this state. The conveying section 7 has a function of controlling the conveying velocity, of the print medium 8 which is being conveyed by the external apparatus 100, at a position of the platen roller 29 (also referred to as a "print position velocity"). More specifically, the conveying section 7 moves a movable body 71 arranged in a conveyance path of the print medium 8 (referred to as a "medium path P") to thereby adjust a length of an upstream part, of the medium path P, on the upstream side of the platen roller 29 in the medium path P, and a length of a downstream part, of the medium path P, on the downstream side of the platen roller 29 in the medium path P. By doing so, the conveying section 7 changes the print position velocity with respect to the conveyance position velocity.

<Frame 10>

Figure 3:
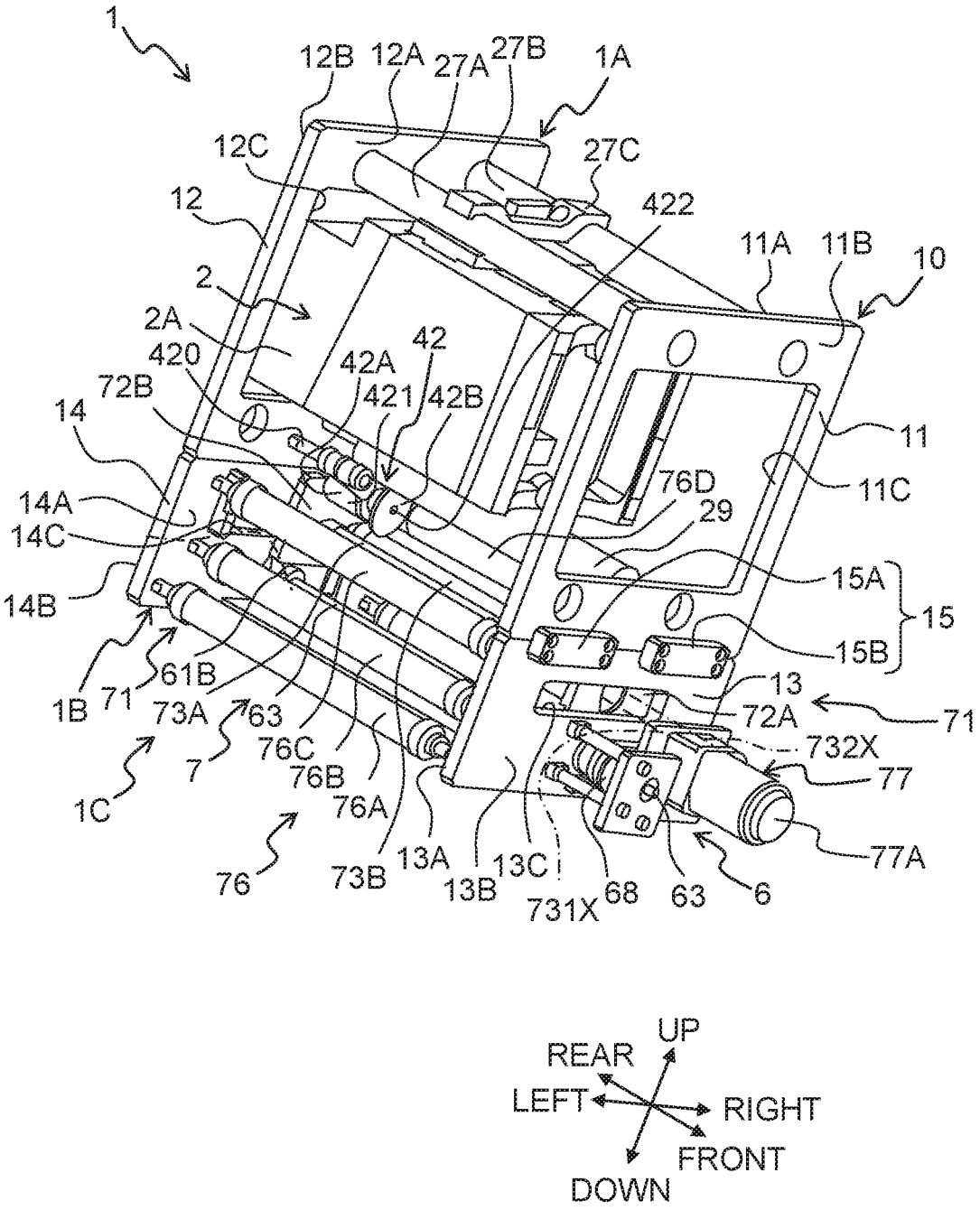
FIG. 3 is a perspective view of the printing apparatus as seen from a left obliquely front side thereof.

As depicted in FIGS. 2 and 3, the printing apparatus 1 has a frame 10. The frame 10 has an upper frame 1A and a lower frame 1B. The upper frame 1A has a first side wall 11 and a second side wall 12. The lower frame 1B has a first side wall 13 and a second side wall 14. The first side walls 11, 13 and the second side walls 12, 14 each have a substantially rectangular-plate shape. Each surface of one of the first side walls 11, 13 and the second side walls 12, 14 is orthogonal to a front-rear direction. The first side wall 11 and the second side wall 12 have an identical shape. The first side wall 11 and the second side wall 12 face each other while being separated in the front-rear direction. The first side wall 11 is arranged on the front side with respect to the second side wall 12. The printing section 2 is arranged between the first side wall 11 and the second side wall 12. The first side wall 13 and the second side wall 14 have an identical shape. The first side wall 13 and the second side wall 14 face each other while being separated in the front-rear direction. The first side wall 13 is arranged on the front side with respect to the second side wall 14. The conveying section 7 is arranged between the first side wall 13 and the second side wall 14. The first side wall 13 is arranged on the lower side with respect to the first side wall 11, and the second side wall 14 is arranged on the lower side with respect to the second side wall 12. Namely, the lower frame 1B is arranged on the lower side (at a position below) the upper frame 1A. The conveying section 7 arranged in the inside of the lower frame 1B is arranged on the lower side (at a position below) the printing section 2 arranged in the inside of the upper frame 1A.

Surfaces of the first side walls 11, 13 oriented to face toward the second side walls 12, 14, respectively, are referred to as first facing surfaces 11A, 13A, respectively. A surface of the first side wall 11 on the opposite side to the first facing surface 11A is referred to as a first opposite surface 11B. A surface of the first side wall 13 on the opposite side to the first facing surface 13A is referred to as a first opposite surface 13B. Surfaces of the second side walls 12, 14 oriented to face toward the first side walls 11, 13, respectively, are referred to as second facing surfaces 12A, 14A, respectively. A surface of the second side wall 12 on the opposite side to the second facing surface 12A is referred to as a second opposite surface 12B. A surface of the second side wall 14 on the opposite side to the second facing surface 14A is referred to as a second opposite surface 14B.

An opening 11C penetrating the first facing surface 11A and the first opposite surface 11B therethrough in the front-rear direction is formed in the first side wall 11. An opening 12C penetrating the second facing surface 12A and the second opposite surface 12B therethrough in the front-rear direction is formed in the second side wall 12. Each of the openings 11C and 12C is rectangular-shaped. A guide groove 13C penetrating the first facing surface 13A and the first opposite surface 13B therethrough in the front-rear direction is formed in the first side wall 13. A guide groove 14C (see FIG. 3) penetrating the second facing surface 14A and the second opposite surface 14B therethrough in the front-rear direction is formed in the second side wall 14. Each of the guide grooves 13C and 14C is a long hole elongated (extending) in the left-right direction.

The first side walls 11, 13 are connected to each other with attaching members 15A, 15B and non-illustrated screws. The second side walls 12, 14 are connected to each other with attaching members 15C, 15D (see FIG. 4) and non-illustrated screws. The attaching members 15A to 15D are collectively referred to as an "attaching member 15". Namely, the upper frame 1A and the lower frame 1B are connected to each other by the attaching member 15. The printing section 2 arranged in the inside of the upper frame 1A and the conveying section 7 arranged in the inside of the lower frame 1B can be separated from each other by removing (detaching) the attaching member 15 and the non-illustrated screws.

<Printing Section 2>

As depicted in FIGS. 1 to 5, the printing section 2 has a casing 2A and the platen roller 29. As depicted in FIGS. 2 to 5, the casing 2A is box-shaped. The casing 2A is arranged at a position below (on the lower side with respect to) columnar-shaped supporting parts 27A, 27B disposed between the first side wall 11 and the second side wall 12. A connecting part 27C arranged on the upper surface of the casing 2A is connected to the supporting parts 27A and 27B.

Figure 5:
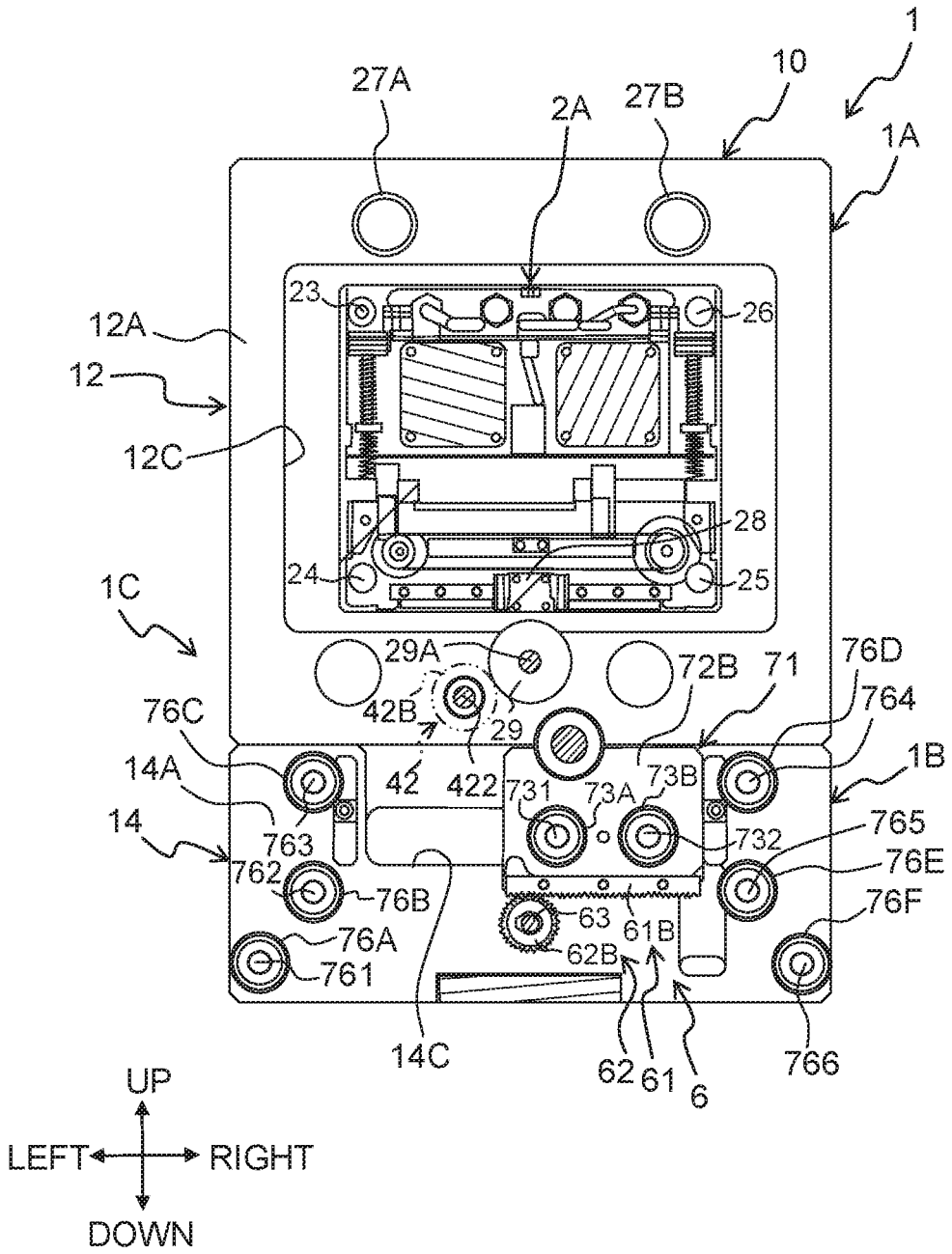
FIG. 5 is a cross-sectional view as seen from a line V-V of FIG. 4.

As depicted in FIGS. 1 and 5, a ribbon installing part 20 (see FIG. 1), guide shafts 23 to 26, and the thermal head 28 are disposed in the inside of the casing 2A. Further, a controller 31, a storing section 32, a driving circuit 37, motors 33 to 35, a communication interface (I/F) 38 and a connection I/F 39 (to be described later on; see FIGS. 12A and 12B) are disposed in the inside of the casing 2A. An operating section 36 (see FIGS. 12A and 12B) is disposed on a surface of the casing 2A.

As depicted in FIG. 1, the ribbon installing part 20 has shafts 21 and 22. Each of the shafts 21 and 22 is a spindle rotatable about a rotation axis extending in the front-rear direction. The roll 9A of the ribbon assembly 90 is installed in the shaft 21. The roll 9B of the ribbon assembly 90 is installed in the shaft 22. The shafts 21 and 22 are directly connected to the shafts of the motors 33 and 34, respectively (see FIGS. 12A and 12B), and are rotatable in accordance with the rotations of the motors 33 and 34, respectively. In a case that the shafts 21 and 22 are rotated in a clockwise direction (clockwise) as seen from the front side, the ink ribbon 9 is let out from the roll 9A, and is wound by the roll 9B. In accordance with the rotations of the shafts 21 and 22, the ink ribbon 9 stretched between the rolls 9A and 9B is conveyed in the inside of the casing 2A. In the following, unless otherwise specifically limited, the rotating direction (clockwise or counterclockwise direction) will be explained with a case of seeing the printing apparatus 1 from the front side, as a premise.

As depicted in FIGS. 1 and 5, the guide shafts 23 to 26 are each a columnar-shaped roller, and is rotatable about a rotation axis extending in the front-rear direction. As depicted in FIG. 1, the ink ribbon 9 stretched between the rolls 9A and 9B makes contact with a part of the circumferential surface of each of the guide shafts 23 to 26, as depicted in FIG. 1. The ink ribbon 9 is guided from the roll 9A toward the roll 9B, while making contact with the guide shafts 23, 24, 25 and 26 in this order. The thermal head 28 makes contact with a part, of the ink ribbon 9, which is located between two positions at which the ink ribbon 9 makes contact with the guide shafts 24 and 25. The thermal head 28 is held to be movable in an up-down direction between a print position 28A and a print stand-by position 28B. The print position 28A is a position at which a lower end part of the thermal head 28 makes contact with the platen roller 29 (to be described later on). The print stand-by position 28B is a position at which the lower end part of the thermal head 28 is separated away from the platen roller 29 toward the upper side with respect to the platen roller 29. The motor 35 (see FIGS. 12A and 12B) moves the thermal head 28 in the up-down direction. In a case that the shafts 21 and 22 are rotated clockwise, the ink ribbon 9 is moved toward the right side (an arrow Y2) at a position at which the ink ribbon 9 makes contact with the thermal head 28.

As depicted in FIGS. 2 to 6, the platen roller 29 is located on the lower side of the casing 2A. The platen roller 29 has a columnar shape. A shaft 29A (see FIGS. 1, 4 to 6), extending along a rotation axis 29X (see FIGS. 1, 2 and 4), which is parallel to the front-rear direction, is inserted into and through the center of the platen roller 29. A front end part of the shaft 29A is supported by the first side wall 11 and a rear end part of the shaft 29A is supported by the second side wall 12. The platen roller 29 is rotatable, with respect to the shaft 29A, about the rotation axis 29X as the center of the rotation. As depicted in FIGS. 1 and 5, the platen roller 29 faces a lower part of the thermal head 28 which is in the inside of the casing 2A. In response to movement of the thermal head 28 from the print stand-by position 28B to the print position 28A (see FIG. 1), the platen roller 29 presses the ink ribbon 9 and the print medium 8 (see FIG. 1) against the thermal head 28.

In the following, a part which is different from the casing 2A and the platen roller 29 in the printing apparatus 1 is referred to as a bracket 1C.

<Conveying Section 7>

Figure 4:
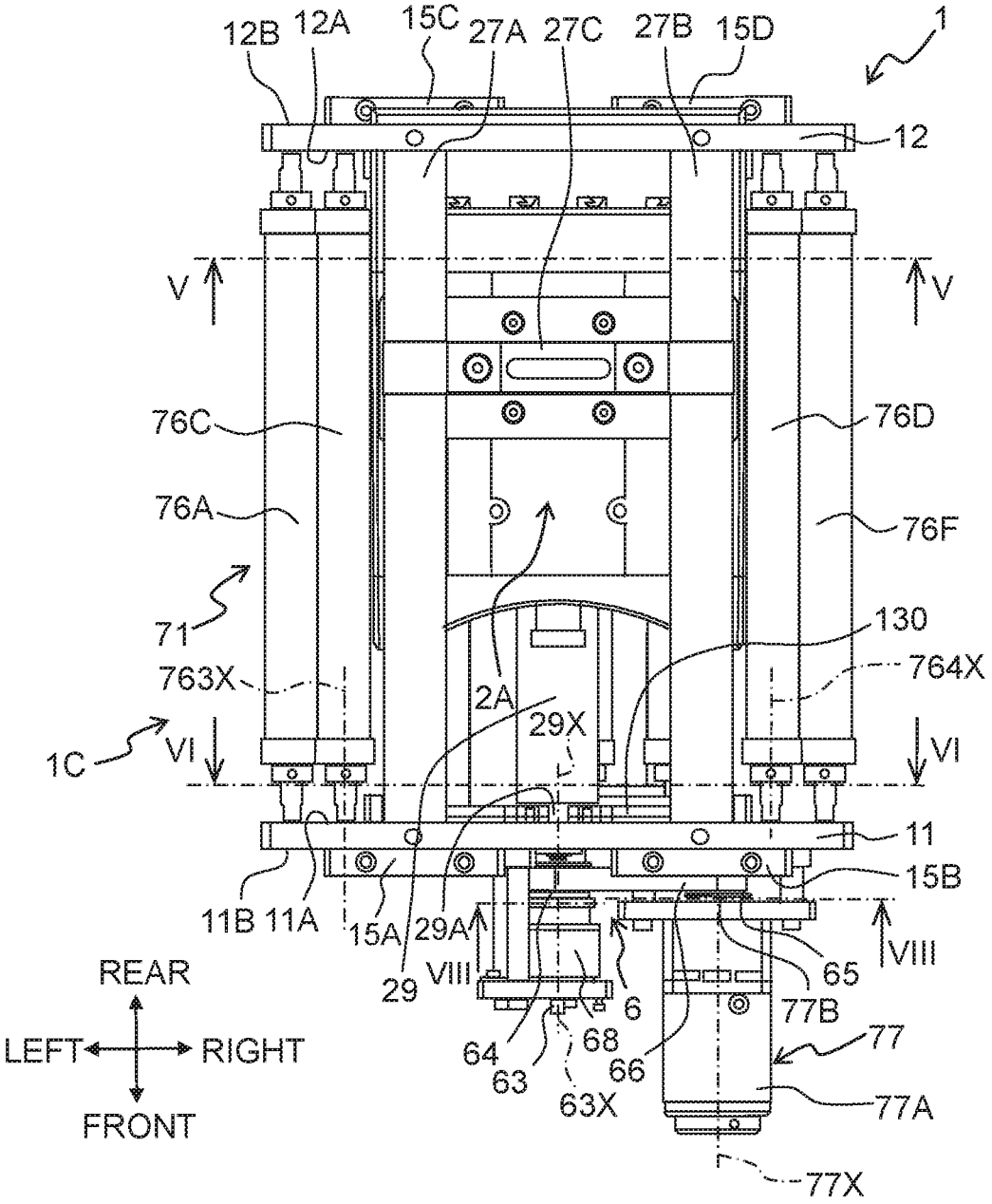
FIG. 4 is a plan view of the printing apparatus as seen from an upper side thereof.

As depicted in FIGS. 1 to 7, the conveying section 7 has the movable body 71 (see FIGS. 1 to 3 and 5 to 7), guide rollers 76A to 76F (collectively referred to as a "guide roller 76") (see FIGS. 1 and 5), a motor 77 (see FIGS. 2 to 4), a transmission device 6 (see FIGS. 1 to 6), and a clutch 68 (see FIGS. 2 to 4). Further, the conveying section 7 is provided with a driving circuit 40, a first sensor 41, a second sensor 42 and a connection I/F 44 (to be described later on) (see FIGS. 12A and 12B).

<Movable Body 71>

The movable body 71 has a first supporting member 72A (see FIGS. 2, 3 and 6), a second supporting member 72B (see FIGS. 2, 3, 5 and 7) (collectively referred to as a "supporting member 72"); a first roller 73A, a second roller 73B (see FIGS. 2, 3 and 5); a guide rail 130 (see FIG. 6); and the guide groove 14C (which has been already described).

Figure 6:
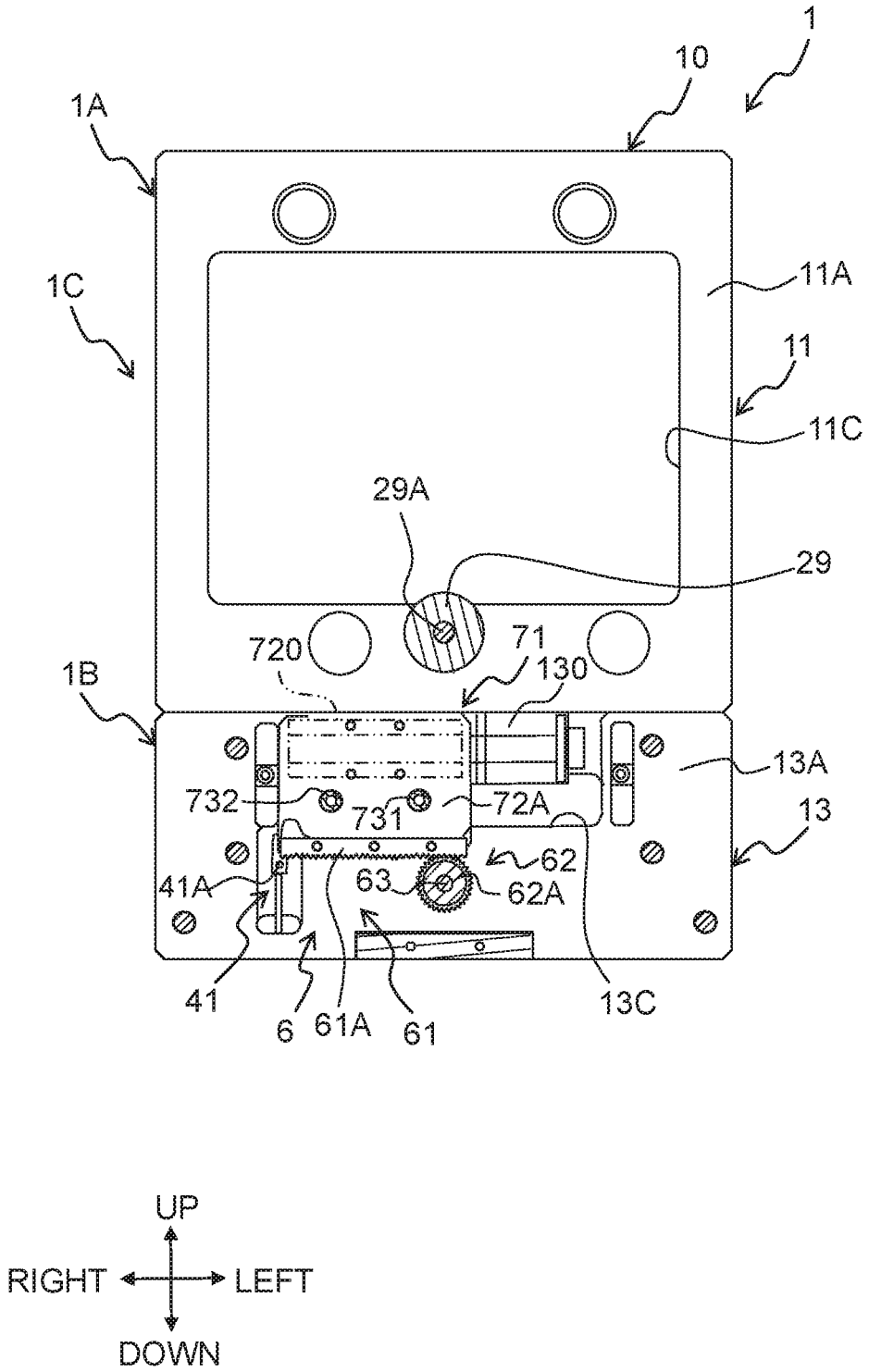
FIG. 6 is a cross-sectional view as seen from a line VI-VI of FIG. 4.

As depicted in FIG. 6, the guide rail 130 is connected to a part, of the first facing surface 13A of the first side wall 13, which is located on the upper side of the guide groove 13C. The guide rail 130 projects rearwardly from the first facing surface 13A. The guide rail 130 linearly extends in the left-right direction along an upper part of the guide groove 13C.

As depicted in FIGS. 2, 3, 5 and 6, the supporting member 72 has a rectangular plate-shape. The supporting member 72 supports a first roller 73A and a second roller 73B (to be described later on). As depicted in FIG. 6, the first supporting member 72A is arranged closely, from the rear side, to a part, of the first facing surface 13A of the first side wall 13, in which the guide rail 130 and the guide groove 13C are provided. A stage 720, engageable with the guide rail 130 disposed in the first facing surface 13A, is disposed on the front surface (the far side of the sheet surface of FIG. 6) of the first supporting member 72A. The stage 720 has two projections projecting frontwardly. The two projections are separated away from each other in the up-down direction, and sandwich the guide rail 130 therebetween in the up-down direction. The spacing distance between the two projections of the stage 720 is slightly greater than the length in the up-down direction of the guide rail 130. The stage 720 is engaged with the guide rail 130 to be movable in the left-right direction which is the extending direction of the guide rail 130. As the guide rail 130 and the stage 720, a commercially available linear guide can be used.

Figure 7:
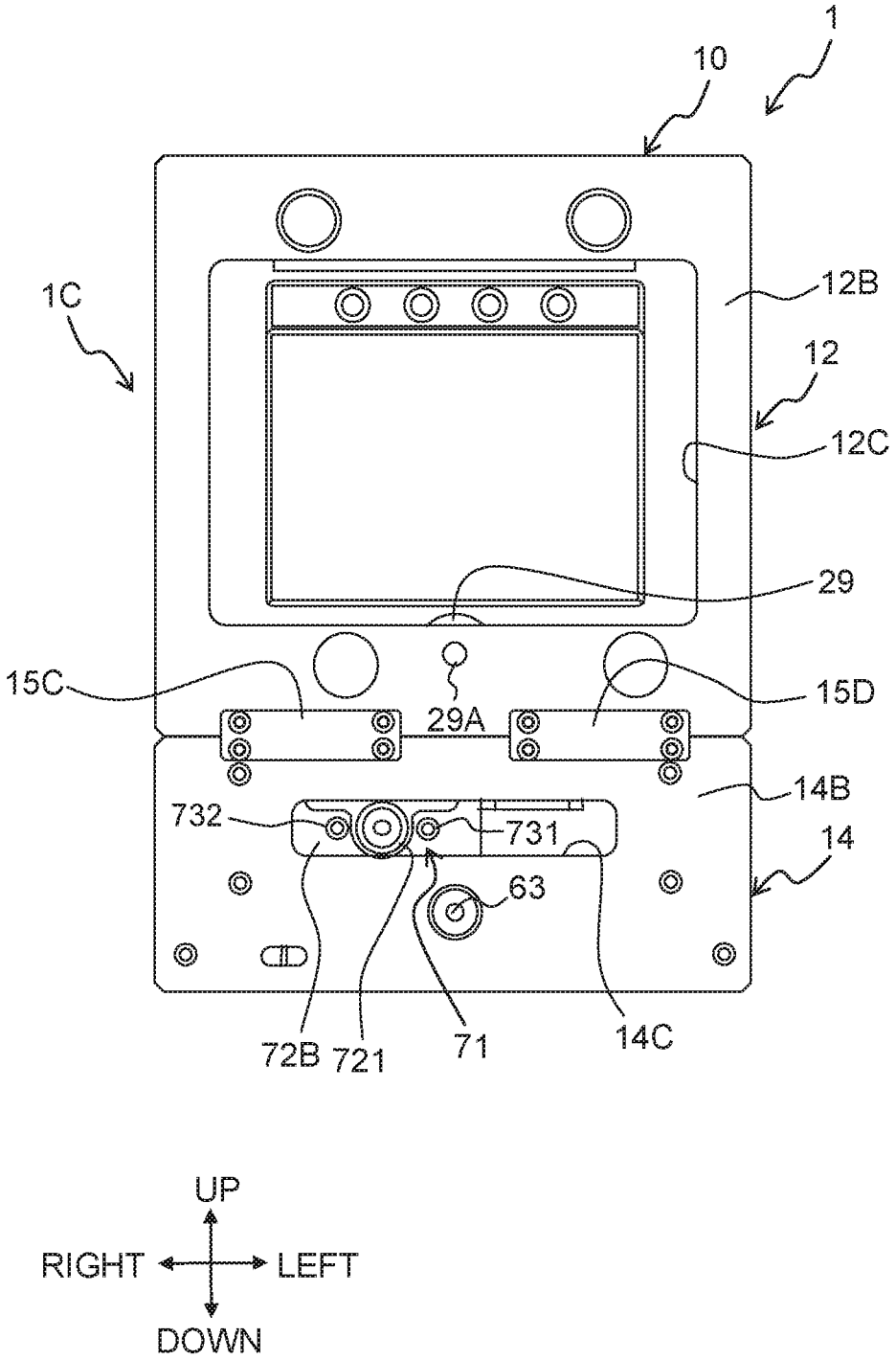
FIG. 7 is a rear view of the printing apparatus as seen from a rear side thereof.

As depicted in FIG. 5, the second supporting member 72B is arranged closely, from the front side, to a certain part, of the second facing surface 14A of the second side wall 14, in which the guide groove 14C is provided and to another part, of the second facing surface 14A, located above the certain part. As depicted in FIG. 7, a projection 721 engageable with the guide groove 14C is provided on a rear surface (the front side in the sheet surface of FIG. 7) of the second supporting member 72B. The shape of the projection 721 is columnar. The center of the projection 721 extends in the front-rear direction. The diameter of the projection 721 is slightly smaller than the spacing distance in the up-down direction of the guide groove 14C. The projection 721 is engaged with the guide groove 14C to be movable in the left-right direction which is the extending direction of the guide groove 14C. The projection 721 is, for example, a roller rotatably supported by the second supporting member 72B.

As depicted in FIGS. 2 and 3, the first roller 73A and the second roller 73B are held between the first supporting member 72A and the second supporting member 72B in the front-rear direction. The first roller 73A and the second roller 73B are arranged side by side in the left-right direction. The first roller 73A is arranged on the left side with respect to the second roller 73B. The first roller 73A and the second roller 73B are moved in the left-right direction integrally with the supporting member 72, in accordance with the movement of the supporting member 72. Namely, the movable body 71 (the supporting member 72, first roller 73A, second roller 73B) is supported to be movable in the left-right direction with respect to the lower frame 1B. Note that in a case that the printing apparatus 1 is used while being placed on a horizontal plane, the left-right direction is parallel to the horizontal direction.

As depicted in FIG. 5, a columnar-shaped shaft 731 extending in the front-rear direction is inserted into and through the first roller 73A. A columnar-shaped shaft 732 extending in the front-rear direction is inserted into and through the second roller 73B. As depicted in FIG. 6, each of front end parts of the shafts 731 and 732 is supported by the first supporting member 72A. As depicted in FIG. 7, each of rear end parts of the shafts 731 and 732 is supported by the second supporting member 72B. The first roller 73A and the second roller 73B are rotatable with respect to the shafts 731 and 732, respectively. As depicted in FIG. 3, a rotation axis 731X of the first roller 73A and a rotation axis 732X of the second roller 73B extend in the front-rear direction while passing through the centers of the shafts 731 and 732, respectively.

<Motor 77, Transmission Device 6>

As depicted in FIGS. 2 to 4, the motor 77 is supported by the first opposite surface 13B of the first side wall 13 of the lower frame 1B. A columnar-shaped body part 77A of the motor 77 projects frontwardly with respect to the first opposite surface 13B. As depicted in FIG. 4, a shaft 77B of the motor 77 extends rearwardly from the body part 77A. A forward end part of the shaft 77B is arranged in front of the first opposite surface 13B of the first side wall 13. The shaft 77B is rotated about a rotation axis 77X extending in the front-rear direction, in accordance with the driving of the motor 77.

As depicted in FIGS. 4 to 8, the transmission device 6 transmits the driving force of the motor 77 to the movable body 71, and moves the movable body 71 in the left-right direction. The transmission device 6 has a first rack gear 61A (see FIG. 6), a second rack gear 61B (see FIG. 5) (collectively referred to as a "rack gear 61"); a first pinion gear 62A (see FIG. 6), a second pinion gear 62B (see FIG. 5) (collectively referred to as a "pinion gear 62"); a driving shaft 63; a first pulley 64 (see FIG. 8); a second pulley 65 (see FIG. 8); a belt 66 (see FIG. 8); a bearing 67 (see FIG. 8); and a clutch 68. The transmission device 6 is supported by the lower frame 1B.

Figure 8:
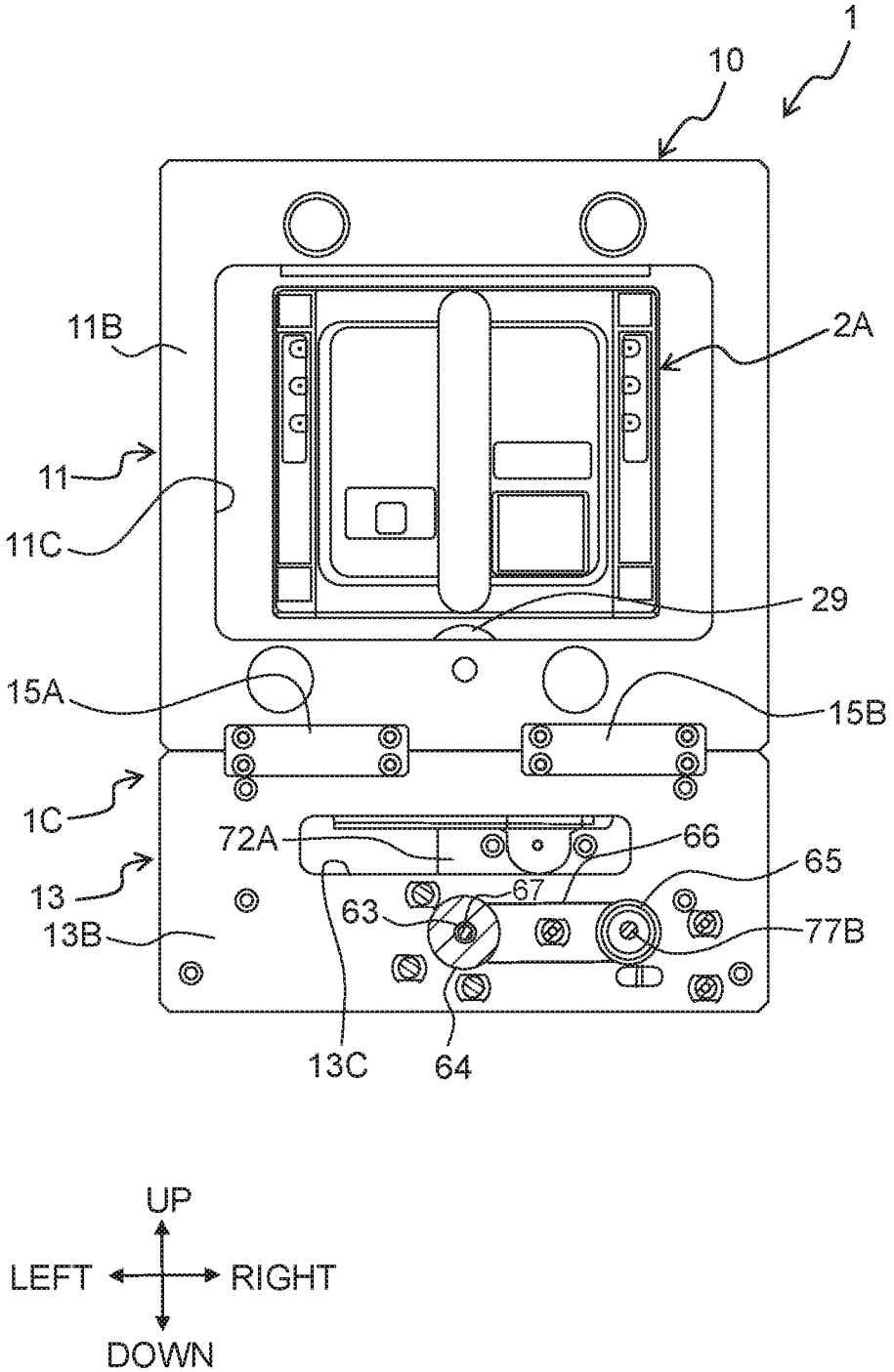
FIG. 8 is a cross-sectional view as seen from a line VIII-VIII of FIG. 4.

As depicted in FIGS. 4 and 8, the second pulley 65 is connected to the shaft 77B of the motor 77. The second pulley 65 is rotated about the rotation axis 77X (see FIG. 4) as the rotation axis of the shaft 77, in accordance with the rotation of the shaft 77B by the driving of the motor 77. The belt 66 is stretched between the first pulley 64 and the second pulley 65 (to be described later on). In a case that the motor 77 is driven, the belt 66 transmits the rotation driving force to the first pulley 64 via the second pulley 65, to thereby rotate the first pulley 64.

As depicted in FIGS. 4 to 8, the driving shaft 63 extends along the front-rear direction at a substantially central part in the left-right direction of the lower frame 1B and at a location below the guide grooves 13C and 14C. As depicted in FIG. 7, a rear end part of the driving shaft 63 is rotatably supported by a part, of the second side wall 14, which is located below the guide groove 14C. As depicted in FIG. 8, a front end part of the driving shaft 63 penetrates through a hole formed in a part, of the first side wall 13C, which is located below the guide groove 13C, and projects frontwardly beyond the first side wall 13. The driving shaft 63 extends in the front-rear direction while passing through a location below the supporting member 72. The driving shaft 63 is rotatable about a rotation axis 63X extending in the front-rear direction. Note that the rotation axis 63X is parallel to the rotation axis 77X which is the rotation axis of the shaft 77B of the motor 77.

As depicted in FIGS. 4 and 8, a part, of the driving shaft 63, projecting frontwardly beyond the first side wall 13, in other words, an outer circumferential surface of the part, of the driving shaft 63, located in front of the first opposite surface 13B of the first side wall 13 is provided with the first pulley 64. The rotation axis of the first pulley 64 is coincident with the rotation axis 63X of the driving shaft 63. Namely, the first pulley 64 is provided coaxially with the driving shaft 63. The first pulley 64 is separated away from the second pulley 65 to be on the left side with respect to the second pulley 65. The belt 66 is stretched between the first pulley 64 and the second pulley 65. The first pulley 64 is rotated about the rotation axis 63X parallel to the driving axis 77X (see FIG. 4) of the second pulley 65, by the driving force of the motor 77 transmitted to the first pulley 64 from the motor 77 via the belt 66.

As depicted in FIG. 8, a bearing 67 is interposed between the driving shaft 63 and the first pulley 64. The bearing 67 reduces the frictional force between the driving shaft 63 and the first pulley 64. Accordingly, even in a case that the first pulley 64 is rotated by the driving force of the motor 77 transmitted to the first pulley 64 by the belt 66, the driving shaft 63 is not rotated, unless the driving force is transmitted from the first pulley 64 to the driving shaft 63 by the clutch 68 (to be described as follows).

As depicted in FIG. 4, the clutch 68 is provided at a location in front of the first pulley 64. The clutch 68 is an electromagnetic clutch having two elements which are an element to which the driving shaft 63 is connected, and an element to which the first pulley 64 is connected. The clutch 68 is switched between a state in which the two elements are connected and a state in which the two elements are disconnected, in accordance with a switching signal outputted from the driving circuit 40 (see FIGS. 12A and 12B). In the state that the two elements are connected, the driving force of the motor 77 is transmitted between the two elements. In the state that the two elements are disconnected, the driving force of the motor 77 is not transmitted between the two elements. In the following, the state in which the two elements are connected in the clutch 68 is referred to as a "connected state", and the state that the two elements are disconnected in the clutch 68 is referred to as a "disconnected state". For example, the clutch 68 may be an excitation operative electromagnetic clutch which maintains the connected state while a driving current as the switching signal is supplied thereto from the driving circuit 40, and maintains the disconnected state while the driving current is not supplied thereto from the driving circuit 40.

As depicted in FIG. 6, the first pinion gear 62A is connected to a part, of the driving shaft 63, located behind the first facing surface 13A of the first side wall 13. The first pinion gear 62A is rotated in accordance with the rotation of the driving shaft 63. As depicted in FIG. 5, the second pinion gear 62B is connected to a part, of the driving shaft 63, located in front of the second facing surface 14A of the second side wall 14. The second pinion gear 62B is rotated in accordance with the rotation of the driving shaft 63.

As depicted in FIG. 6, the first rack gear 61A is provided on a lower end part of the first supporting member 72A. The length in the left-right direction of the first rack gear 61A is substantially same as the length in the left-right direction of the first supporting member 72A. The first rack gear 61A has teeth in a lower part thereof. The first pinion gear 62A is arranged at a location below the first rack gear 61A. The teeth of the first pinion gear 62A mesh with the teeth of the first rack gear 61A from therebelow. As depicted in FIG. 5, the second rack gear 61B is provided on a lower end part of the second supporting member 72B. The length in the left-right direction of the second rack gear 61B is substantially same as the length in the left-right direction of the second supporting member 72B. Note that the lower end part of the supporting member 72 is located at a position below each of the lowermost end parts of the outer circumferential surfaces of the first roller 73A and the second roller 73B. Accordingly, the rack gear 61 (the first rack gear 61A and second rack gear 61B) is located at the position below the lowermost end part of the outer circumferential surface of each of the first roller 73A and the second roller 73B. The second rack gear 61B has teeth in a lower part thereof. The second pinion gear 62B is arranged on the lower side of the second rack gear 61B. The teeth of the second pinion gear 62B mesh with the teeth of the second rack gear 61B from therebelow. The rack gear 61 extends in the left-right direction.

In a case that the clutch 68 is in the connected state and that the shaft 77B is rotated in accordance with the driving of the motor 77, the driving force of the motor 77 is transmitted to the driving shaft 63 via the second pulley 65, the belt 66, the first pulley 64 and the clutch 68. The pinion gear 62 connected to the driving shaft 63 moves the rack gear 61 in the left-right direction in accordance with the rotation of the driving shaft 63. With this, the movable body 71 is moved in the left-right direction. In a case that the shaft 77B of the motor 77 is rotated in the counterclockwise direction, the movable body 71 moves leftwardly. In a case that the shaft 77B of the motor is rotated in the clockwise direction, the movable body 71 moves rightwardly.

As depicted in FIG. 1, in a movable direction (left-right direction) in which the movable body 71 is movable, leftward direction is referred to as a "first direction", and rightward direction is referred to as a "second direction". The rotating direction (counterclockwise direction) of the shaft 77B of the motor 77 in a case that the movable body 71 is caused to move in the first direction is referred to as "toward one side". The rotating direction (clockwise direction) of the shaft 77B of the motor 77 in a case that the movable body 71 is caused to move in the second direction is referred to as "toward the other side".

Figure 9A:
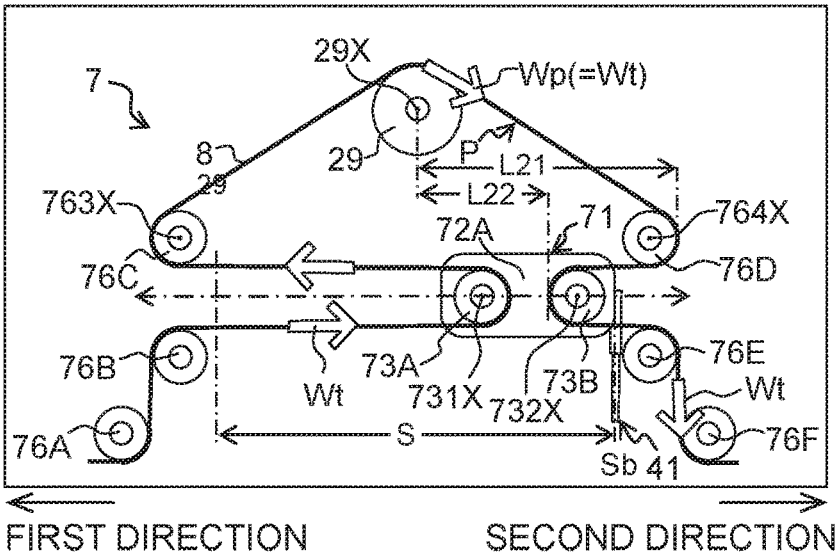
FIGS. 9A to 9C are views for explaining an operation of a movable body.

As depicted in FIG. 9A, a range in which the first supporting member 72A is movable in the left-right direction is referred to as a "moving range". The moving range S corresponds to a range from an end part, on the one side, of the first supporting member 72A which is moved farthest in the first direction to an end part, on the other side, of the first supporting member 72A which is moved farthest in the second direction. A position of the end part in the second direction of the first supporting member 72A which is moved farthest in the second direction is referred to as a "reference position Sb". The reference position Sb corresponds to a position separated farthest in the second direction from the end part in the first direction of the moving range S. A state or situation in which the end part in the second direction of the first supporting member 72A is located at the reference position Sb is referred to as "the movable body 71 is arranged at the reference position Sb". FIGS. 5 to 8 depict a state of the movable body 71 arranged at the reference position Sb. A position of the center in the left-right direction of the moving range S is coincident with the position of the rotation axis 29X of the platen roller 29.

<First Sensor 41>

As depicted in FIG. 6, a first sensor 41 is provided on a part, of the first facing surface 13A of the first side wall 13, located below a right end part of the guide groove 13C. The first sensor 41 is a proximity sensor of the non-contact type. The proximity sensor is appropriately selected among those of photoelectric type, eddy current type (electromagnetic induction type), ultrasonic wave type, etc., depending on the material of the first supporting member 72A. The first sensor 41 has a detector 41A extending upwardly. The position in the left-right direction of the detector 41A is substantially same as the position of the end part in the second direction of the first supporting member 72A in the case that the movable body 71 is arranged at the reference position Sb, namely, is substantially same as the reference position Sb (see FIGS. 9A to 9C). The detector 41A detects proximity or contact of the first supporting member 72A in a range corresponding to a predetermined length in the left-right direction (referred also as a "detecting range"). In the following, a case that the detector 41A detects the proximity or contact of the first supporting member 72A is simply referred to as "the detector 41A detects the first supporting member 72A". The first sensor 41 is capable of outputting a signal indicating the presence or absence of the detection of the first supporting member 72A by the detector 41A. Note that it is also allowable that a limit switch is used as the first sensor 41, rather than using the proximity sensor.

<Second Sensor 42>

As depicted in FIG. 3, a second sensor 42 is provided on a location below the platen roller 29. The second sensor 42 has a rotary encoder 42A and a rotating plate 42B. The rotary encoder 42A is accommodated in the inside of a columnar-shaped body 421. The body 421 is fixed to the second side wall 12 by a stick-shaped attaching part 420 which extends frontwardly from the second facing surface 12A of the second side wall 12. A shaft 422 of the rotary encoder 42A extends frontwardly from the body 421, parallel to the rotation axis 29X (see FIG. 2) of the platen roller 29. The disc-shaped rotating plate 42B is connected to the shaft 422. As depicted in FIG. 1, a circumferential end part of the rotating plate 42B makes contact with a left obliquely lower part of the circumferential surface of the platen roller 29. The rotating plate 42B and the shaft 422 are rotated in accordance with the rotation of the platen roller 29. The rotary encoder 42A detects a rotation amount of the shaft 422, and outputs a signal in accordance with the rotation amount (hereinafter referred to as a "rotation signal"). More specifically, the rotary encoder 42A alternately outputs a Hi signal and a Low signal every time the shaft 422 is rotates by a predetermined angle. In the following, the situation that the rotation signal is outputted from the rotary encoder 42A of the second sensor 42 is referred to as "the rotation signal is outputted from the second sensor 42".

<Guide Roller 76>

As depicted in FIGS. 1 to 5, the guide rollers 76A to 76F (collectively referred to as the "guide roller 76") are arranged at a position below the platen roller 29 and between the first side wall 13 and the second side wall 14. The guide roller 76 has a columnar shape. Shafts 761 to 766 (see FIGS. 1 and 5) each of which extends along a rotation axis parallel to the front-rear direction are inserted into the centers of the guide rollers 76A to 76F, respectively. A front end part of each of the shafts 761 to 766 is supported by the first side wall 13, and a rear end part of each of the shafts 761 to 766 is supported by the second side wall 14. The guide roller 76 is rotatable about the rotation axis with respect to any one of the shafts 761 to 766 corresponding thereto.

In the following, as depicted in FIGS. 2 and 4, among the respective rotation axes, a rotation axis extending in the front-rear direction while passing through the center of the shaft 763 of the guide roller 76C is referred to as a "rotation axis 763X", and a rotation axis extending in the front-rear direction while passing through the center of the shaft 764 of the guide roller 76D is referred to as a "rotation axis 764X". The rotation axis 63X, the rotation axis 763X, the rotation axis 764X, the rotation axis 29X and the rotation axis 77X each extend in the front-rear direction orthogonal to the left-right direction as the moving direction of the movable body 71. The rotation axis 63X, the rotation axis 763X, the rotation axis 764X, the rotation axis 29X and the rotation axis 77X are parallel to one another.

As depicted in FIG. 1, the guide rollers 76A, 76B and 76C are arranged on the left side with respect to the platen roller 29 in the left-right direction. The positions of the guide rollers 76B and 76C in the left-right direction are substantially same. The guide roller 76A is arranged on the left side with respect to the guide rollers 76B and 76C in the left-right direction. The guide rollers 76D, 76E and 76F are arranged on the right side with respect to the platen roller 29 in the left-right direction. The positions of the guide rollers 76D and 76E in the left-right direction are substantially same. The guide roller 76F is arranged on the right side with respect to the guide rollers 76D and 76E in the left-right direction. The guide rollers 76C and 76D are arranged on the upper side with respect to the movable body 71 in the up-down direction. The positions of the guide rollers 76C and 76D in the up-down direction are substantially same. The guide rollers 76A, 76B, 76E and 76F are arranged on the lower side with respect to the movable body 71 in the up-down direction. The positions of the guide rollers 76A and 76F in the up-down direction are substantially same. The positions of the guide rollers 76B and 76E in the up-down direction are substantially same. The guide roller 76A is arranged on the left obliquely lower side with respect to the guide roller 76B. The guide roller 76F is arranged on the right obliquely lower side with respect to the guide roller 76E.

Figure 9B:
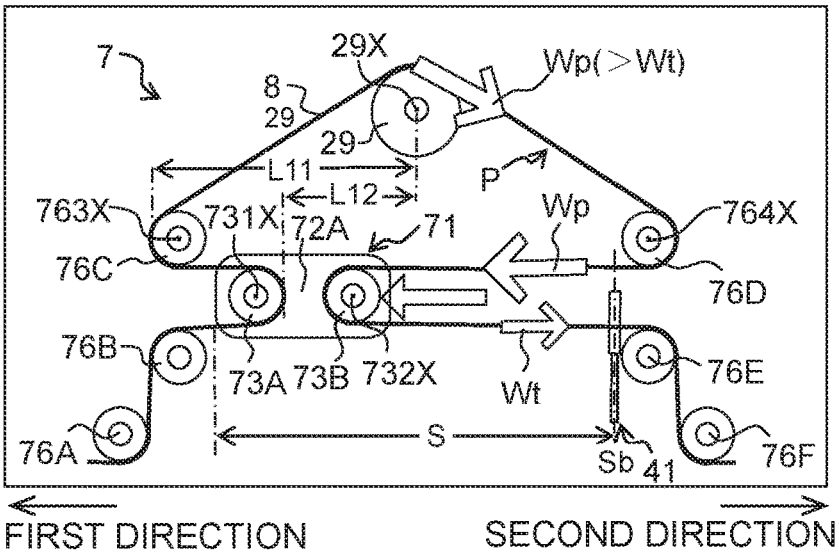

As depicted in FIG. 9A, in a state that the movable body 71 is moved farthest in the second direction, namely in a state that the movable body 71 is arranged at the reference position Sb, the rotation axis 732X of the second roller 73B is arranged on the left side with respect to the shafts 764 and 765 of the guide rollers 76D and 76E, respectively, in the left-right direction. As depicted in FIG. 9B, in a state that the movable body 71 is moved farthest in the first direction, the rotation axis 731X of the first roller 73A is arranged on the right side with respect to the shafts 762 and 763 of the guide rollers 76B and 76C, respectively, in the left-right direction.

Figure 12A:
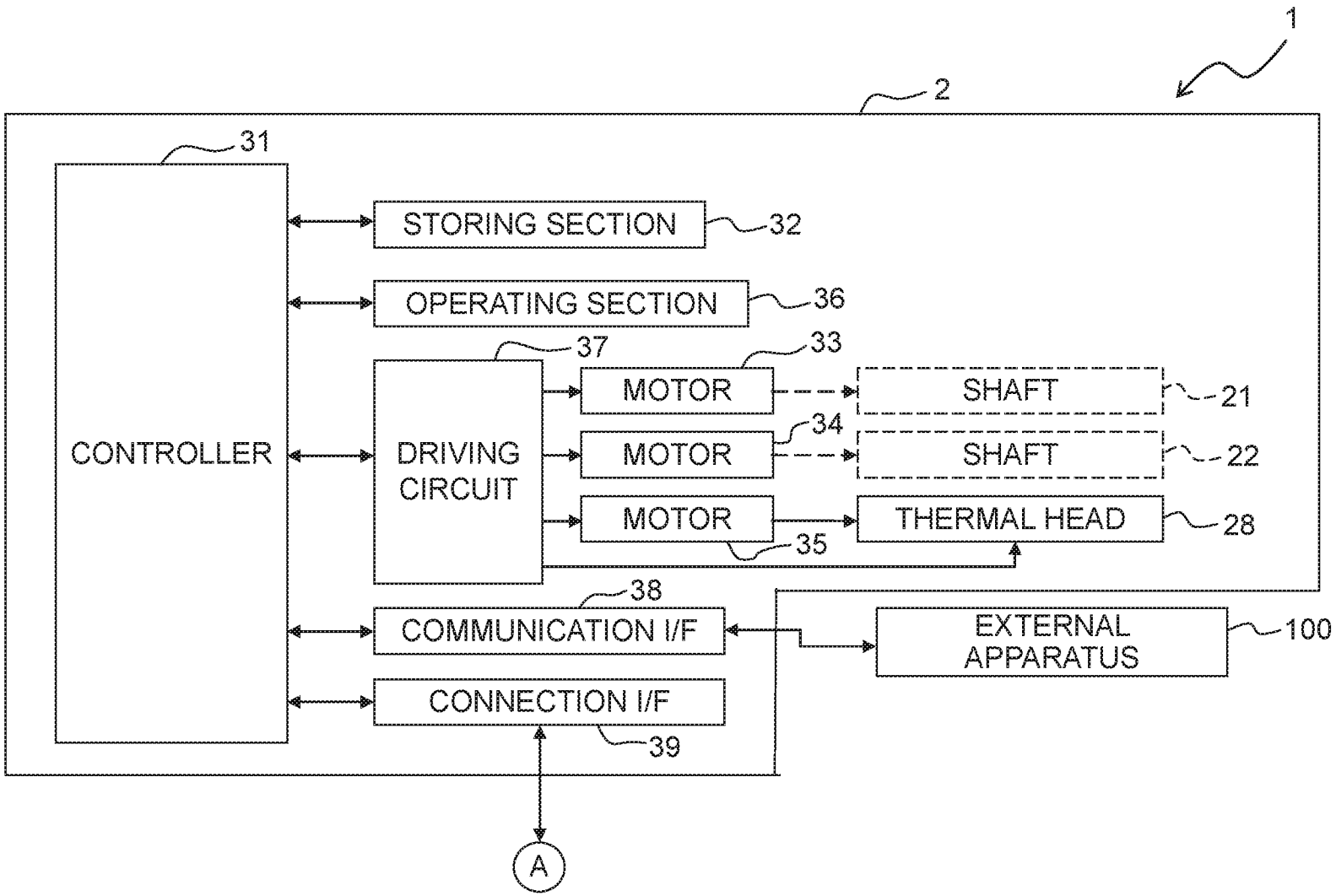
FIGS. 12A and 12B are a block diagram depicting the electrical configuration of the printing apparatus.
Figure 12B:
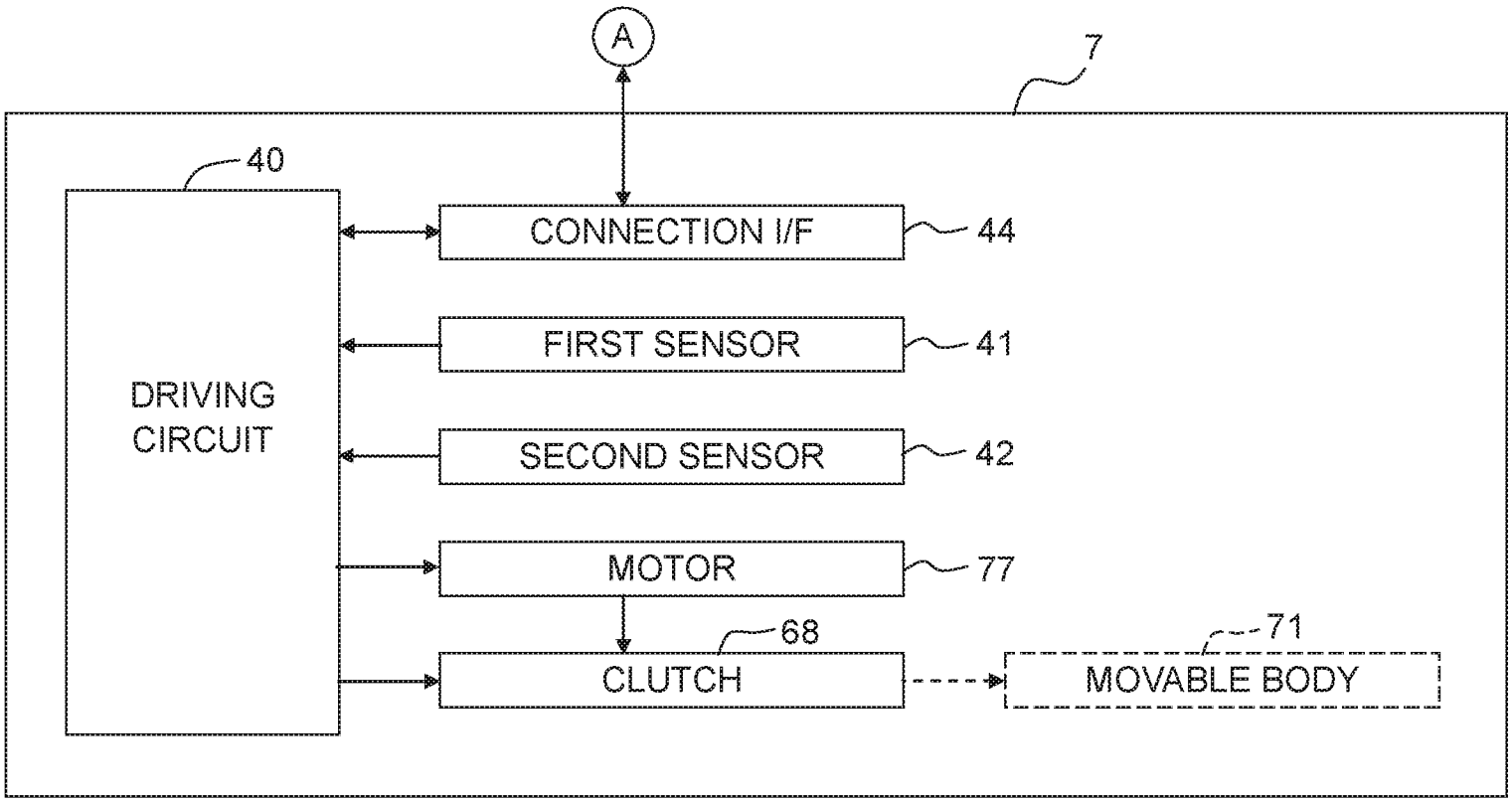

As depicted in FIG. 1, the print medium 8 is supplied to the conveying section 7 from the outside of the printing apparatus 1 by the external apparatus 100 (see FIGS. 12A and 12B). In the inside of the printing apparatus 1, the print medium 8 is stretched among the platen roller 29, the first roller 73A and the second roller 73B of the movable body 71, and the guide roller 76, and is conveyed. A path via which the print medium 8 passes while being conveyed along the platen roller 29, the first roller 73A, the second roller 73B and the guide roller 76 corresponds to the medium path P. The medium path P extends while changing the direction as making contact sequentially with each of the guide rollers 76A and 76B, the first roller 73A, the guide roller 76C, the platen roller 29, the guide roller 76D, the second roller 73B, and the guide rollers 76E and 76F. The print medium 8 is conveyed in a direction moving, along the medium path P, from the guide roller 76A toward the guide roller 76F (a direction of arrows Y1). The guide rollers 76A to 76C, and the first roller 73A of the movable body 71 are arranged on the upstream side with respect to the platen roller 29 in the medium path P. The guide rollers 76D to 76F, and the second roller 73B of the movable body 71 are arranged on the downstream side with respect to the platen roller 29 in the medium path P. Although a specific explanation will be given later on, the first roller 73A and the second roller 73B are moved in the left-right direction to thereby guide the print medium 8. With this, the medium path P is changed.

As depicted in FIGS. 9A and 9B, a moving velocity of the print medium 8, at a position of the print medium 8 at which the print medium 8 makes contact with the platen roller 29, is expressed as a "print position velocity Wp". The moving velocity of the print medium 8, at a position on the opposite side to the platen roller 29 with respect to the movable body 71, in other words, at a position on the upstream side with respect to the first roller 73A, or at a position on the downstream side with respect to the second roller 73B corresponds to the conveyance position velocity. The conveyance position velocity is expressed as the "conveyance position velocity Wt". The conveyance position velocity Wt corresponds to a conveying velocity in a case that the print medium 8 is supplied to the conveying section 7 of the printing apparatus 1 from the external apparatus 100. As depicted in FIG. 9A, in a case that the movable body 77 stands still, the print position velocity Wp is coincident with the conveyance position velocity Wt.

Figure 9C:
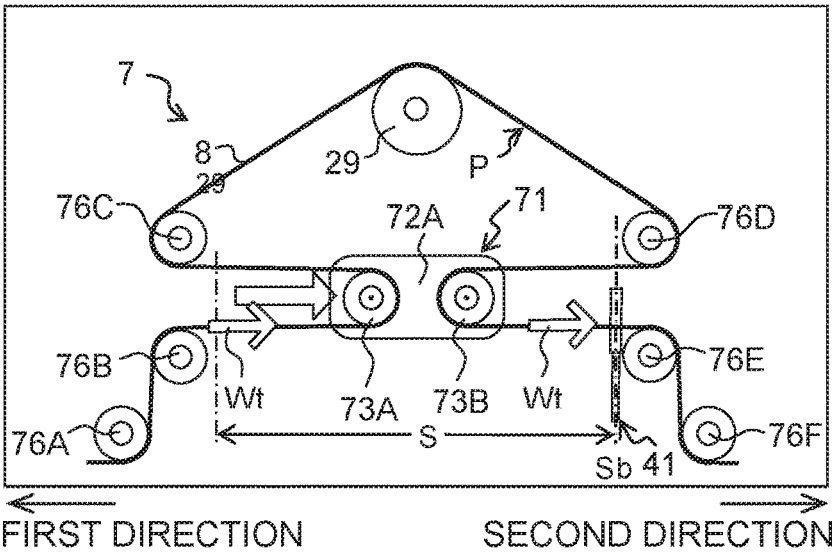

On the other hand, as depicted in FIG. 9B, a part of the medium path P which is located between the platen roller 29 and the first roller 73A becomes short and a part of the medium path P which is located between the platen roller 29 and the second roller 73B becomes long, in response to the movement of the movable body 71 in the first direction. In this case, a force toward the downstream side acts on a part, of the print medium 8, on the side of the platen roller 29 with respect to the movable body 71. This consequently makes the print position velocity Wp to be faster than the conveyance position velocity Wt. On the other hand, as depicted in FIG. 9C, the part of the medium path P which is located between the platen roller 29 and the first roller 73A becomes long and the part of the medium path P which is located between the platen roller 29 and the second roller 73B becomes short, in response to the movement of the movable body 71 in the second direction. In this case, a force toward the upstream side acts on the part, of the print medium 8, on the side of the platen roller 29 with respect to the movable body 71. This consequently makes the print position velocity Wp to be slower than the conveyance position velocity Wt, and becomes 0.

<Overview of Printing Operation by Printing Apparatus 1>

An explanation will be given about the overview of a printing operation by the printing apparatus 1, with reference to FIG. 1 and FIGS. 10A to 10E. The following explanation is given on a premise that the external apparatus 100 supplies the print medium 8 to the printing apparatus 1 at the conveyance position velocity Wt and that the movable body 71 stands still at the reference position Sb (see FIG. 9A). Since the movable body 71 is not moved, the print position velocity Wp is coincident with the conveyance position velocity Wt (see FIG. 9A).

As depicted in FIGS. 10A to 10E, a plurality of pieces of an eye mark m (m(1), m(2) . . . ) are printed in advance on the print medium 8 respectively at predetermined positions (for example, positions closer to an end part in the width direction of the print medium 8). The eye marks m are arranged at equal intervals in the length direction of the print medium 8, with a predetermined spacing distance D1 therebetween. The external apparatus 100 is provided with an optical sensor 101 capable of detecting the eye marks m of the print medium 8. The optical sensor 101 is disposed on the outside of the printing apparatus 1, for example, at a part, of the medium path P, which is located adjacently on the downstream side with respect to a position at which the print medium 8 makes contact with the guide roller 76F (see FIG. 1), or located adjacently on the upstream side with respect to a position at which the print medium 8 makes contact with the guide roller 76A. The following explanation will be given with a case, as an example, in which the optical sensor 101 is arranged at the part, of the medium path P, which is located on the downstream side with respect to the position at which the print medium 8 makes contact with the guide roller 76F (see FIG. 1). Note that for the purpose that the explanation will be easily understood, in FIGS. 10A to 10E, the ink ribbon 9 and the print medium 8 are depicted in a linearly manner and the ink ribbon 9 and the print medium 8 are away from each other. In reality, however, the ink ribbon 9 is conveyed while being bent by the guide shafts 23 to 26 (see FIG. 1), and the print medium 8 is conveyed while being bent by the guide rollers 76A to 76F (see FIG. 1). Further, the ink ribbon 9 and the print medium 8 make contact with each other at least at a position at which the thermal head 28 makes contact with the ink ribbon 9.

Figure 10A:
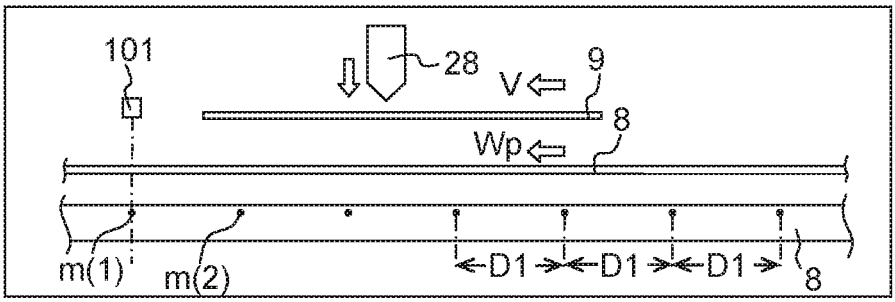
FIGS. 10A to 10E are views for explaining the overview of a printing operation.

As depicted in FIG. 10A, the thermal head 28 is arranged at the print stand-by position 28B (see FIG. 1). The external apparatus 100 starts the conveyance of the print medium 8. In a case that the external apparatus 100 detects the eye mark m(1) by the optical sensor 101, the external apparatus 100 outputs a signal (referred to as a "print signal"), indicating that the print medium 8 is located at a printable position, to the printing apparatus 1.

In a case that the printing apparatus 1 receives the print signal, the printing apparatus 1 rotates the shafts 21 and 22 (see FIG. 1) to thereby convey the ink ribbon 9. In a case that a conveying velocity of the ink ribbon 9 (referred to as a "ribbon velocity V") is increased up to a desired velocity, the thermal head 28 is moved from the print stand-by position 28B to the print position 28A (see FIG. 1). The desired velocity is same, for example, as the print position velocity Wp (see FIGS. 9A to 9C). In a case that the reduction in the usage amount of the ink ribbon 9 is desired, the desired velocity may be set, for example, to be a velocity slower than the print position velocity Wp (for example, a velocity slower than the print position velocity Wp by several percents to several tens of percents). The following explanation will be given, as an example, with a case in which the desired velocity is same as the print position velocity Wp, for the purpose of simplification. The thermal head 28 makes contact with the platen roller 29 (see FIG. 1) from thereabove via the ink ribbon 9 and the print medium 8. The ink ribbon 9 is pressed against a print surface of the print medium 8 in accordance with the movement of the thermal head 28. The platen roller 29 makes contact with a surface, of the print medium 8, on the opposite side to the print surface of the print medium 8, and presses the ink ribbon 9 and the print medium 8 against the thermal head 28. The conveyance direction and the conveying velocity of the ink ribbon 9 and those of the print medium 8, respectively, are coincident to each other at the position at which the ink ribbon 9 and the print medium 8 make contact with each other (Ribbon Velocity V=Print Position Velocity Wp=Conveyance Position Velocity Wt).

Figure 10B:
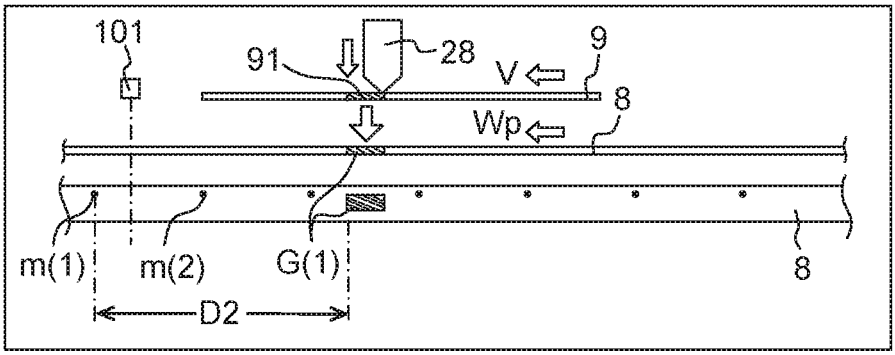

The thermal head 28 is heated. As depicted in FIG. 10B, the ink in a predetermined region 91 of the ink ribbon 9 is transferred onto the print surface of the print medium 8. In the manner as described above, a print image G(1) for one block corresponding to the eye mark m(1) is printed on the print medium 8. A length from the eye mark m(1) up to the print image G(1) is expressed as the length "D2". Note that when the print image G(1) is being printed, the print medium 8 and the ink ribbon 9 are continuously conveyed at a same velocity (Ribbon Velocity V=Print Position Velocity Wp). Note that the print position velocity Wp is not necessarily being limited as being constant; the print position velocity Wp is changed in accordance with a processing performed in the external apparatus 100, in some cases. Provided that the print position velocity Wp is changed, the printing apparatus 1 changes the ribbon velocity V in accordance with the change in the print position velocity Wp.

Figure 10C:
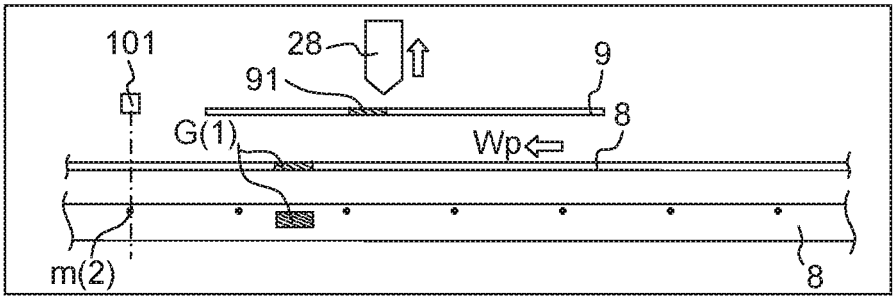

After the print image G(1) is printed, the heating of the thermal head 28 is stopped. As depicted in FIG. 10C, the thermal head 28 is moved from the print position 28A to the print stand-by position 28B. Here, when the printing is not executed, the rotations of the shafts 21 and 22 may be stopped and thus to stop the conveyance of the ink ribbon 9, in order to reduce the usage amount of the ribbon (Ribbon velocity V=0 (zero)). With this, the printing operation for printing the print image G(1) is ended. Note that since the print medium 8 is conveyed continuously by the external apparatus 100, the print position velocity Wp is maintained.

Figure 10D:
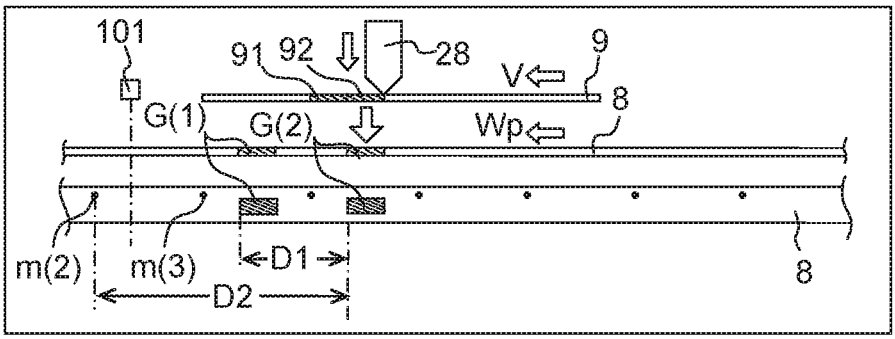

The print medium 8 is conveyed, and the next eye mark m(2) is detected by the optical sensor 101 (see FIG. 10C). In this case, the external apparatus 100 outputs the print signal to the printing apparatus 1. The printing apparatus 1 receives the print signal, and starts the printing operation for next one block. As depicted in FIG. 10D, the ink ribbon 9 is conveyed by the rotations of the shafts 21 and 22. The thermal head 28 is moved from the print stand-by position 28B to the print position 28A. The thermal head 28 is heated after having been moved to the print position 28A, and the ink in a predetermined region 92 of the ink ribbon 9 is transferred onto the print surface of the print medium 8. In the manner as described above, a print image G(2) corresponding to the eye mark m(2) is printed on the print medium 8. A length between the print image G(1) to the print image G(2) is same as the length between the eye marks m which is the length "D1". A length from the eye mark m(2) to the print image G(2) is same as the length D2 which is the length between the eye mark m(1) up to the print image G(1).

Figure 10E:
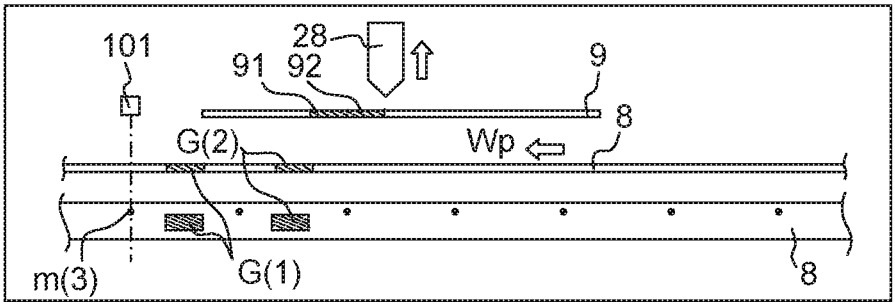

After the print image G(2) is formed, the heating of the thermal head 28 is stopped. As depicted in FIG. 10E, the thermal head 28 is moved from the print position 28A to the print stand-by position 28B. The conveyance of the ink ribbon 9 is stopped (Ribbon Velocity V=0 (zero)). In the manner as described above, the printing operation for the print image G(2) is ended.

<Control of Print Position Velocity Wp by Movement of Movable body 71>

There is such a case that the conveyance position velocity Wt of the print medium 8 by the external apparatus 100 is decelerated. In this case, in a case that the print position velocity Wp of the print medium 8 becomes equal to or less than a predetermined velocity Vth, there is such a possibility that the printing apparatus 1 might not be able to maintain a satisfactory printing quality. The reason for this is that the ribbon velocity V is adjusted based on the print position velocity Wp; and if the print position velocity Wp is equal to or less than the predetermined velocity Vth, a narrower region of the ink ribbon 9 is heated by the thermal head 28 for a long period of time than in another case that the print position velocity Wp is not less than the predetermined velocity Vth. In this case, the temperature of the heated region of the ink ribbon 9 is increased to be higher than an appropriate temperature, and an image is reversely transferred onto the print medium 8 and/or the ink ribbon 9, which in turns causes any bleeding and/or faintness of the ink, etc., to easily occur. The predetermined velocity Vth is a value determined by the characteristics of the thermal head 28 and the ink ribbon 9, and is assumed to be stored in advance in the storing section 32 at a time of shipment of the printing apparatus 1 from the factory. Note that the predetermined velocity Vth may be appropriately set by a user via the operating section 36 (see FIGS. 12A and 12B).

Accordingly, in a case that the print position velocity Wp of the print medium 8 becomes equal to or less than the predetermined velocity Vth, the printing apparatus 1 allows the clutch 68 to be in the connected state, while causing the motor 77 to rotate toward the one side. With this, the movable body 77 is moved in the first direction (see FIG. 9B). In response to the movement of the movable body 71 in the first direction, the print position velocity Wp is accelerated, and becomes to be greater than the conveyance position velocity Wt (see FIG. 9B). With this, the printing apparatus 1 is in a state that the print position velocity Wp is greater than the predetermined velocity Vth, thereby maintaining a satisfactory printing quality.

On the other hand, in response to the movable body 71 caused to move from the reference position in the first direction, the medium path P between the platen roller 29 and the second roller 73B becomes long (see FIG. 9B). In a case that the printing operation is executed in this state, the length D2 (see FIGS. 10B, 10D) between an eye mark m(i) ("i" is an integer) and a print image G(i) corresponding to the eye mark m(i) becomes longer to an extent corresponding to the elongation of the length of the medium path P between the platen roller 29 and the second roller 73B, than in a case that the printing operation is executed in a state that the movable body 71 is arranged at the reference position. In this case, there is such a case that it might not be possible to print the print image G(i) corresponding to the eye mark m(i) at a desired position in the print medium 8. For this reason, the printing apparatus 1 preferably starts the printing operation for printing the image G(i), in the state that the movable body 71 is arranged at the reference position.

Figure 11A:
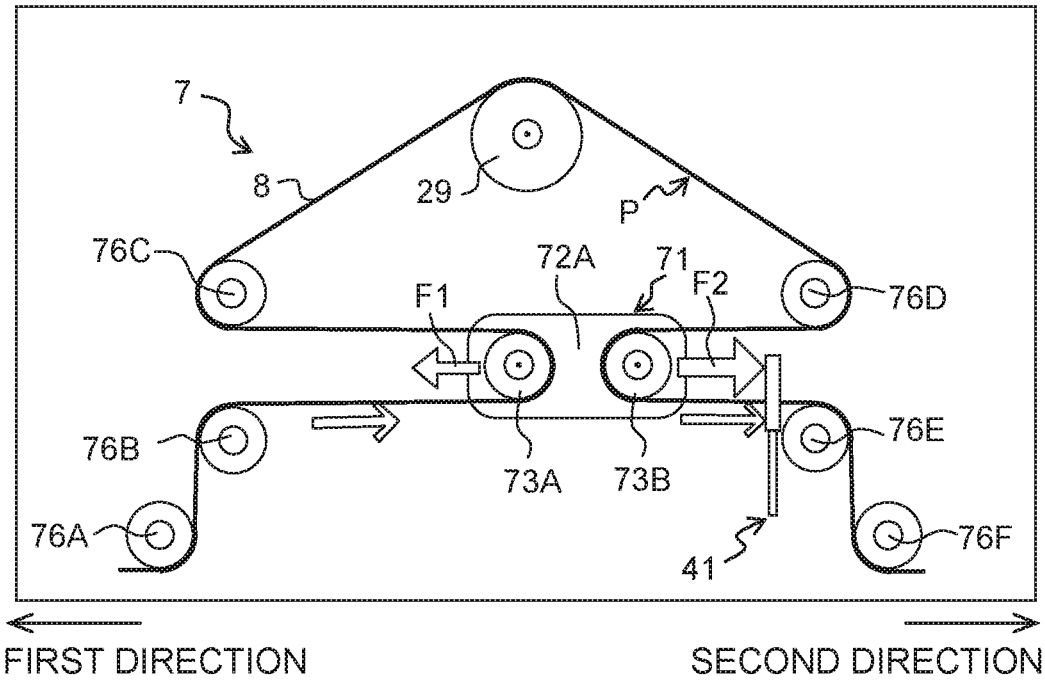
FIGS. 11A and 11B are views for explaining a situation in which the movable body is moved in a state that a print medium is (being) conveyed by an external apparatus.
Figure 11B:
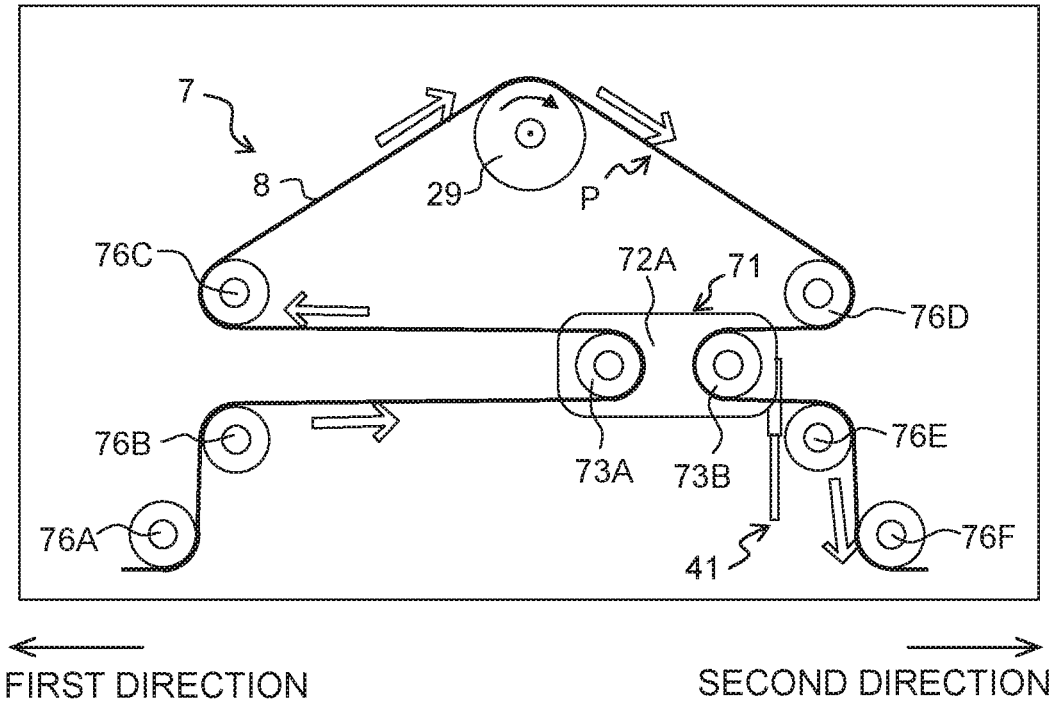

In view of the above-described situation, the printing apparatus 1 moves the movable body 71 in the second direction so as to arrange the movable body 71 at the reference position, after a printing operation for a print image G(i−1) is ended and before a printing operation for a next print image G(i) is started. This is performed specifically in a following manner. For example, the printing apparatus 1 allows the clutch 68 to be in the disconnected state after the printing operation for the print image G(i−1) is ended and before the printing operation for the next print image G(i) is started. Note that even after the clutch 68 is allowed to be in the disconnected state, the print medium 8 is continuously conveyed by the external apparatus 100. In this case, as depicted in FIG. 11A, a force F1 in the first direction received by the first roller 73A from the print medium 8 becomes smaller than a force F2 in the second direction received by the second roller 73B from the print medium 8. The reason for this is that the print medium 8 is supplied to the printing apparatus 1 from the side of the first roller 73A among the medium path P, and that the tension (tensile force) acting on the first roller 73A from the print medium 8 becomes smaller than the tension acting on the second roller 73B by the print medium 8. Accordingly, in the case that the clutch 68 is allowed to be in the disconnected state, the movable body 71 is moved in the second direction and toward the reference position, and reaches the reference position (see FIG. 11B). The printing apparatus 1 starts the printing operation for the next print image G(i) after the movable body 71 has moved up to the reference position. With this, the printing apparatus 1 is capable of making the length D2 from the eye mark m(i) to the print image G(i) be constant, thereby making it possible to print the print image G(i) corresponding to the eye mark m(i) at a desired position in the print medium 8.

<Electrical Configuration of Printing Apparatus 1>

An explanation will be given about the electrical configuration of the printing section 2 and the conveying section 7 of the printing apparatus 1. As depicted in FIGS. 12A and 12B, the printing section 2 is provided with a controller 31, the storing section 32, the operating section 36, the driving circuit 37, the motors 33 to 35, the thermal head 28, the communication interface (I/F) 38 and the connection I/F 39. The conveying section 7 is provided with the driving circuit 40, the first sensor 41, the second sensor 42, the motor 77, the clutch 68 and the connection I/F 44.

The controller 31 includes a CPU controlling the printing section 2 and the conveying section 7; a ROM storing respective kinds of initial parameters; a RAM temporarily storing information; etc. The controller 31 is electrically connected to the storing section 32, the operating section 36, the driving circuit 37, the communication I/F 38 and the connection I/F 39 via a non-illustrated interface circuit.

The storing section 32 stores a program of a processing executed by the controller 31, a print data, a variety of kinds of setting information, etc. Each of the variety of kinds of setting information includes a predetermined value Rth. The predetermined value Rth indicates a rotation amount per unit time of the platen roller 29 in a case that the print position velocity Wp of the print medium 8 is the predetermined velocity Vth. The program, the print data, and the variety of kinds of setting information may be read from a storage medium (for example, a USB memory, a SD card, etc.) connected to the communication I/F 38 (to be described later on). The controller 31 may store the read program, print data and variety of kinds of setting information in the storing section 32. The variety of kinds of setting information may be input, for example, via the operating section 36 (to be described in the following). The controller 31 may store the input variety of kinds of setting information in the storing section 32.

The operating section 36 is an interface (a button, a touch panel, etc.) to which a variety of kinds of information can be input. The driving circuit 37 includes, for example, a circuit, etc., configured to output a signal to each of the motors 33 to 35 and the thermal head 28. The motors 33 to 35 are each a stepping motor which is rotated synchronizing with a pulse signal. The motor 33 rotates the shaft 21. The motor 34 rotates the shaft 22. The motor 35 moves the thermal head 28 between the print position 28A (see FIG. 1) and the print stand-by position 28B (see FIG. 1) via a non-illustrated head holding mechanism. The thermal head 28 is a line thermal head having a plurality of heating elements which are linearly arranged side by side in the front-rear direction. Each of the plurality of heating elements is selectively heated in accordance with a signal outputted from the controller 31. The communication I/F 38 is an interface element configured to perform communication between the printing section 2 and the external apparatus 100 which is connected to the printing section 2, based on a universal standard (for example, USB standard). The connection I/F 39 is an interface element configured to perform communication based on a universal standard (for example, LVDS (Low Voltage Differential Signaling) standard, etc.). The connection I/F 39 and the connection I/F 44 of the conveying section 7 (to be described later on) are connected to each other via a cable supporting the LVDS standard. A communication based on the LVDS standard is executed between the connection I/F 39 and the connection I/F 44.

The driving circuit 40 includes a circuit configured to detect a signal outputted from the controller 31 of the printing section 2 via the connection I/F 39 and the connection I/F 44, and to output the detected signal to the motor 77 and the clutch 68. Further, the driving circuit 40 includes a circuit configured to detect a signal outputted from each of the first sensor 41 and the second sensor 42, and to output the detected signals to the controller 31 via the connection I/F 44 and the connection I/F 39; etc. The connection I/F 44 is an interface element configured to perform communication based on a variety of kinds of universal standard.

In the following, an operation or action in which the controller 31 outputs a signal to the motors 33 to 35 via the driving circuit 37 is simply referred to that "the controller 31 outputs a signal to the motors 33 to 35"; an operation or action in which the controller 31 outputs a signal to the motor 77 and the clutch 68 via the connections I/F 39 and 44 and the driving circuit 40 is simply referred to that "the controller 31 outputs a signal to the motor 77 and the clutch 68"; and an operation or action in which the controller 31 detects a signal outputted from each of the first sensor 41 and the second sensor 42 via the driving circuit 40, the connection I/F 44 and the connection I/F 39 is simply referred to that "the controller 31 detects a signal outputted from each of the first sensor 41 and the second sensor 42".

The first sensor 41 outputs, to the driving circuit 40, a signal in accordance with the presence/absence of detection of the first supporting member 72A by the detector 41A. A signal outputted from the first sensor 41 in a state that the first supporting member 72A is detected by the detector 41A is referred to as an "ON signal". A signal outputted from the first sensor 41 in a state that the first supporting member 72A is not detected by the detector 41A is referred to as an "OFF signal". In a case that the shaft 422 is rotated in accordance with the rotation of the platen roller 29, the second sensor 42 outputs a signal in accordance with the rotation amount of the shaft 422 to the driving circuit 40.

The motor 77 is, for example, a so-called AC speed control motor in which a velocity detecting sensor is built in an AC motor. The motor 77 rotates the shaft 77B toward the one side or the other side, in accordance with a driving signal outputted from the driving circuit 40. A driving signal in a case of rotating the shaft 77B of the motor 77 toward the one side is referred to as a "driving-toward-one-side signal". A driving signal in a case of rotating the shaft 77B of the motor 77 toward the other side is referred to as a "driving-toward-other-side signal". The clutch 68 is switched between the connected state and the disconnected state depending on a switching signal.

<Main Processing>

An explanation will be given about a main processing with reference to FIGS. 13A and 13B. The print medium 8 is installed in the conveying section 7 in a state that the conveyance of the print medium 8 by the external apparatus 100 is stopped. The print medium 8 is arranged along the medium path P. The movable body 71 is arranged at the reference position. The external apparatus 100 outputs a starting instruction for starting the printing operation to the printing apparatus 1, in a state that the conveyance of the print medium 8 is stopped. The controller 31 detects the starting instruction via the communication I/F 38. The controller 31 reads and executes the program stored in the storing section 32, to thereby start the main processing.

Figure 13A:
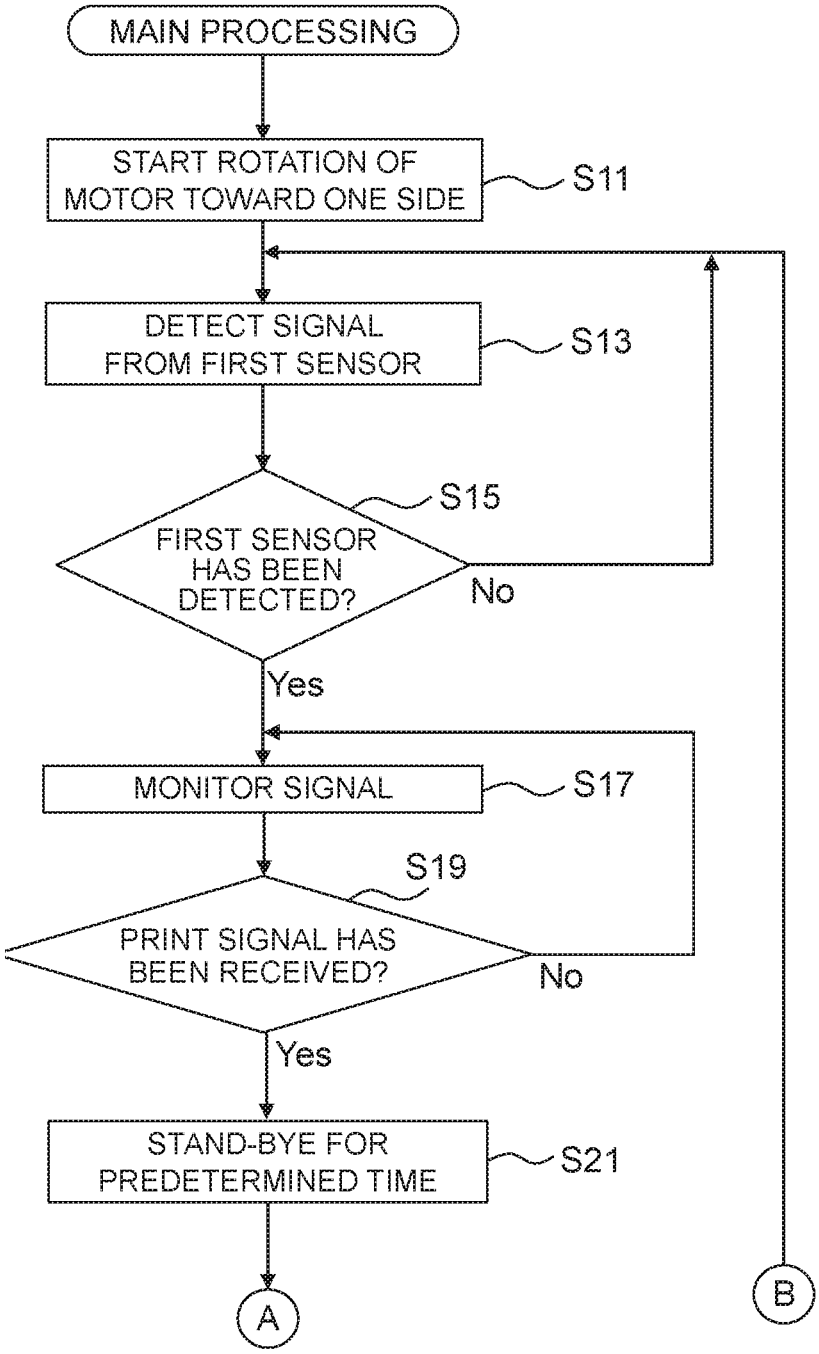
FIGS. 13A and 13B are a flow chart of a main processing.
Figure 13B:
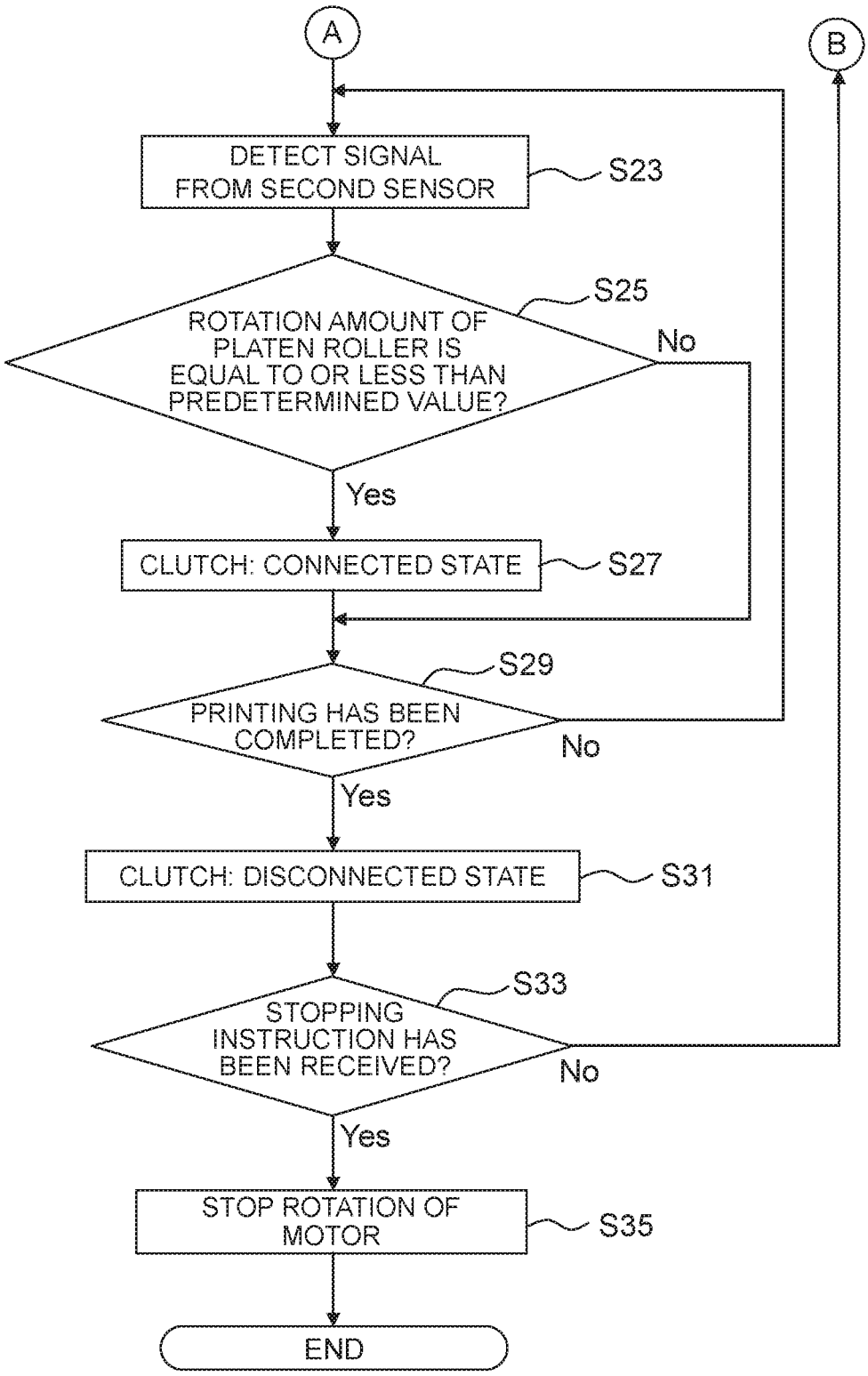

As depicted in FIGS. 13A and 13B, at first, the controller 31 starts the outputting of the driving-toward-one-side signal to the motor 77, regardless of the rotation signal outputted from the second sensor 42 and the print signal received via the communication I/F 38. The shaft 77B of the motor 77 is started to rotate toward the one side (S11). The controller 31 detects the signal outputted from the first sensor 41 (S13). Note that at a time when the main processing is started, the movable body 71 is arranged at the reference position. Therefore, the first sensor 41 detects the first supporting member 72A by the detector 42A, and outputs the ON signal. The controller 31 detects the ON signal. The controller 31 determines that the first supporting member 72A is detected by the detector 41A of the first sensor 41 (S15: YES).

The controller 31 monitors the signal received via the communication I/F 38 (S17). The controller 31 determines whether the controller 31 receives the print signal, outputted from the external apparatus 100, via the communication I/F 38 (S19). In a case that the controller 31 determines that the controller 31 does not receive the print signal (S19: NO), the controller 31 returns the processing to step S17. The controller 31 repeats the monitoring regarding the signal received via the communication I/F 38 (S17). The conveyance of the print medium 8 is started by the external apparatus 100. In response to the start of the conveyance of the print medium 8, the eye mark m is detected by the optical sensor 101. The external apparatus 100 outputs the print signal to the printing apparatus 1. In a case that the controller 31 determines that the controller 31 has received the print signal via the communication I/F 38 (S19: YES), the controller 31 stands by for a predetermined time until the conveyance position velocity Wt of the print medium 8 by the external apparatus 100 is stabilized (S21). After the predetermined time has elapsed, the controller 31 starts the printing operation for one block.

The specific of the printing operation is as follows. The controller 31 drives the motors 33 and 34 (see FIGS. 12A and 12B) so as to rotate the shafts 21 and 22 (see FIG. 1), thereby conveying the ink ribbon 9. In a case that the ribbon velocity V of the ink ribbon 9 is increased up to the conveyance position velocity Wt (see FIGS. 9A to 9C), the controller 31 moves the thermal head 28 from the print stand-by position 28B up to the print position 28A (see FIG. 1). The controller 31 heats the thermal head 28 based on the print data stored in the storing section 32. In the manner as described above, the printing operation for one block is executed (see FIGS. 10A to 10E).

While the controller 31 is executing the printing operation, the controller 31 detects the rotation signal outputted from the second sensor 42 (S23). The controller 31 calculates a rotation amount per unit time of the shaft 422 of the rotary encoder 42A based on the detected rotation signal. The controller 31 calculates a rotation amount per unit time of the platen roller 29 (hereinafter referred simply to a "rotation amount of the platen roller 29") based on the calculated rotation amount per unit time of the shaft 422 and the ratio of the diameter of the rotating plate 42B to the diameter of the platen roller 29.

The controller 31 determines whether the calculated rotation amount of the platen roller 29 is equal to or less than the predetermined value Rth (S25). In a case that the rotation amount of the platen roller 29 is equal to or less than the predetermined value Rth, the moving velocity at a position, of the print medium 8, at which the print medium 8 makes contact with the platen roller 29, namely, the print position velocity Wp is equal to or less than the predetermined velocity Vth. In a case that the controller 31 determines that the calculated rotation amount of the platen roller 29 is equal to or less than the predetermined velocity Rth (S25: YES), the controller 31 advances the processing to step S27. The controller 31 outputs the switching signal to the clutch 68 to thereby allow the clutch 68 to be in the connected state (S27) so as to accelerate the print position velocity Wp. Since the shaft 77B of the motor 77 rotates toward the one side (see S11), the transmission device 6 allows the clutch 68 to be in the connected state to thereby transmit the rotation driving force of the motor 77 to the movable body 71. The movable body 71 is moved from the reference position in the first direction. Note that the controller 31 controls the driving-toward-one-side signal which is outputted to the motor 77 such that the moving velocity of the movable body 71 in the case that the movable body 71 is moved in the first direction becomes not less than ½ the predetermined velocity Vth. The print position velocity Wp becomes greater than the conveyance position velocity Wt, and is accelerated until the print position velocity Wp becomes not less than the predetermined velocity Vth. The controller 31 advances the processing to step S29. On the other hand, in a case that the rotation amount of the platen roller 29 is greater than the predetermined value Rth, the moving velocity at the position, of the print medium 8, at which the print medium 8 makes contact with the platen roller 29, namely the print position velocity Wp is greater than the predetermined velocity Vth. In a case that the controller 31 determines that the calculated rotation amount of the platen roller 29 is greater than the predetermined value Rth (S25: NO), the controller 31 advances the processing to step S29.

The controller 31 determines whether the printing operation for one block has been ended (S29). In a case that the controller 31 determines that the printing operation for one block has not been ended (S29: NO), the controller 31 returns the processing to step S23. The controller 31 detects the signal outputted from the second sensor 42 (S23), and repeats the determination of step S25.

In a case that the printing operation for one block has been ended (S29: YES), the controller 31 stops the heating of the thermal head 28. The controller 31 moves the thermal head 28 from the print position 28A up to the print stand-by position 28B. The controller 31 stops the rotations of the shafts 21 and 22 to thereby stop the conveyance of the ink ribbon 9 (see FIGS. 10A to 10E). The controller 31 outputs the switching signal to the clutch 68 to thereby allow the clutch 68 to be in the disconnected state (S31). Note that the print medium 8 is being conveyed continuously by the external apparatus 100 and that the shaft 77B of the motor 77 is being rotated continuously toward the one side. Note that in a case that the clutch 68 is allowed to be in the connected state by the processing of step S27, the movable body 71 is arranged at a position which is away from the reference position in the first direction. In such a case, the movable body 71 starts moving in the second direction toward the reference position (see FIG. 11A).

The controller 31 determines whether a stopping instruction, for stopping the printing operation by the printing apparatus 1, is received via the operating section 36 (S33). Note that the stopping instruction may be outputted from the external apparatus 100 with respect to the printing apparatus 1. The controller 31 may determine whether the stopping instruction is received via the communication I/F 38. In a case that the controller 31 determines that the stopping instruction is not received (S33: NO), the controller 31 returns the processing to step S13. The controller 31 detects the signal outputted from the first sensor 41 (S13). In a case that the detected signal is the OFF signal, the controller 31 determines that the first supporting member 72A is not detected by the detector 41A of the first sensor 41 (S15: NO). In this case, the movable body 71 has not reached the reference position. The controller 31 returns the processing to step S13. In a case that the detected signal is the ON signal, the controller 31 determines that the first supporting member 72A is detected by the detector 41A of the first sensor 41 (S15: YES). In this case, since the movable body 71 has reached the reference position, the controller 31 advances the processing to step S17.

On the other hand, in a case that the controller 31 determines that the stopping instruction has been received (S33: YES), the controller 31 stops the outputting of the driving-toward-one-side signal with respect to the motor 77, and stops the rotation of the shaft 77B of the motor 77 toward the one side (S35). The controller 31 ends the main processing.

Primary Action and Effect of the Embodiment

The printing apparatus 1 starts the rotation of the motor 77, regardless of the rotation signal outputted from the second sensor 42 and the print signal received via the communication I/F 38 (S11). In a case that the rotation amount of the platen roller 29 is determined to be equal to or less than the predetermined value Rth (S25: YES), the printing apparatus 1 allows the clutch 68 to be in the connected state. In this case, the driving force of the motor 77 is transmitted to the movable body 71, thereby moving the movable body 71 in the first direction. With this, even if, for example, the conveyance position velocity Wt of the print medium 8, which is being conveyed by the external apparatus 100, is lowered, the print position velocity Wp is maintained.

Since the motor 77 moving the movable body 71 is an AC motor, there occurs a delay since the outputting of the driving-toward-one-side signal to the motor 77 until the shaft 77B starts to rotate toward the one side, in some cases. For example, at least a time obtained by adding the delay time until the start of the rotation and a time required for the motor 77 to accelerate up to the desired rotational velocity (through-up time) is necessary in order to start the rotation of the motor 77, with the print signal which is outputted from the external apparatus 100 in accordance with the detection of the eye mark m as the starting point, and to perform printing at a desired position of the print medium 8.

Figure 14A:
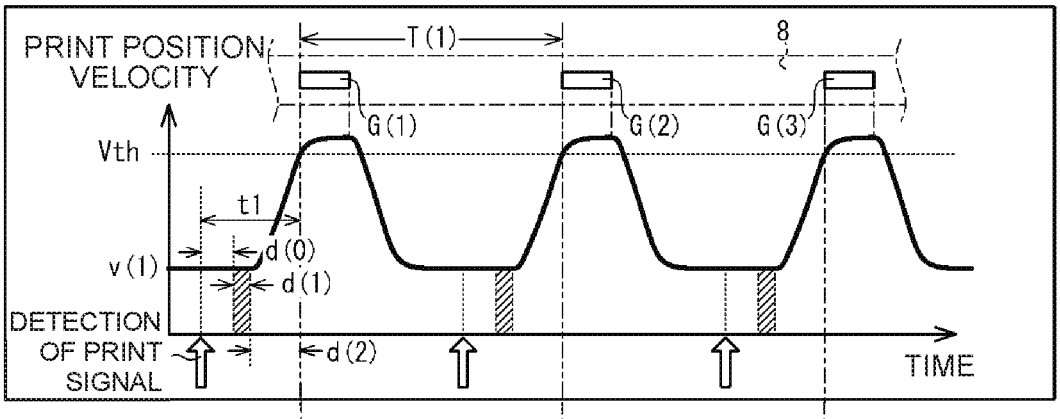
FIGS. 14A to 14C are each a view depicting a relationship between a print position velocity and a timing at which a print image is printed.
Figure 14B:
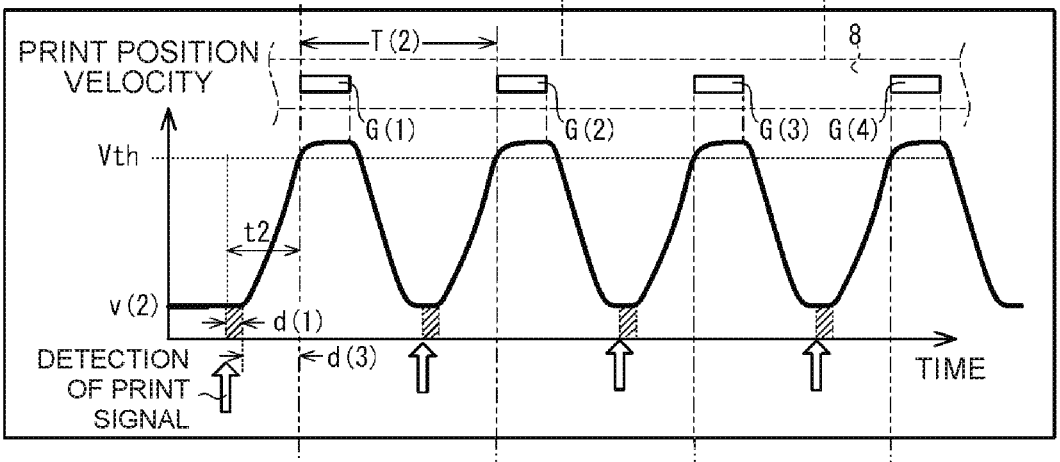
Figure 14C:
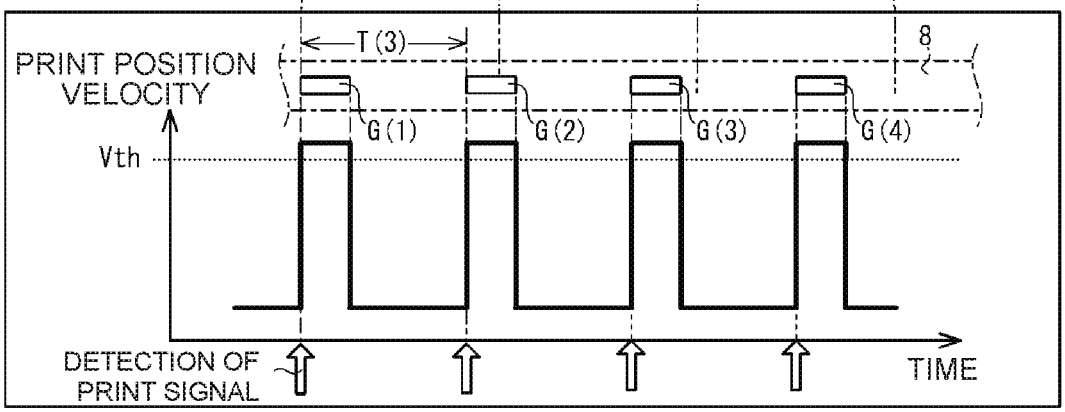

A specific explanation will be given about the above-described situation with reference to FIGS. 14A to 14C. A time d(1) in FIG. 14A indicates the delay time since the outputting of the driving-toward-one-side signal to the motor 77 and until the shaft 77B of the motor 77 starts to rotate toward the one side. A time d(2) in FIG. 14A indicates the through-up time. In a case depicted in FIG. 14A, a time ti since the detection of a print signal in accordance with the detection of the eye mark m and until a print start timing, at which printing of the print image G with respect to a desired position of the print medium 8 is started, is longer than a time (d(1)+d(2)). Accordingly, the printing apparatus 1 outputs the driving-toward-one-side signal to the motor 77 at a timing going back from the print start timing by the time (d(1)+d(2)), in other words, at a timing at which a time d(0)(=t1−(d(1)+d(2)) has elapsed since the detection of the print signal. With this, the printing apparatus 1 is capable of accelerating the print position velocity Wp from an initial velocity v(1) up to a predetermined velocity Vth, before the print start timing. Accordingly, the printing apparatus 1 is capable of recording the print image G at a desired position of the print medium 8 under a condition that the print position velocity Wp is made to be not less than the predetermined velocity Vth. Note that the spacing distance (interval) between a print image G(1), a print image G(2) . . . is described as an interval T(1).

In view of the above-described situation, for example, in a case that the conveying velocity of the print medium 8 by the external apparatus 100 is low and/or that the interval between the print images G is short, there is such a possibility that the print position velocity Wp might not be increased up to the predetermined velocity Vth at a time when the desired position of the print medium 8 reaches a print position in which printing by the thermal head 28 is to be performed. FIG. 14B depicts an example wherein the initial velocity of the print position velocity Wp is an initial velocity v(2) slower than the initial velocity v(1), and that the interval between the print images G(1), G(2) . . . is an interval T(2) shorter than the interval T(1). The through-up time is a time d(3) which is longer than the time d(2) in FIG. 14A. Note that a time t2 since the detection of the print signal and until the print start timing is substantially same as a time (d(1)+d(3)). In this case, provided that, if the printing apparatus 1 does not output the driving-toward-one-side signal to the motor 77 immediately after the detection of the print signal, it is not possible to accelerate the print position velocity Wp from the initial velocity v(2) up to the predetermined velocity Vth, before the print start timing. Further, for example, such an example is provided wherein the initial velocity of the print position velocity Wp is further slower than the initial velocity v(2) and the interval between the print images G(1), G(2) . . . is further shorter than the interval T(2). In this case, even if the driving-toward-one-side signal is outputted to the motor 77 immediately after the detection of the print signal, there is such a possibility that it might not be possible to accelerate the print position velocity Wp up to the predetermined velocity Vth, before the print start timing. Accordingly, the printing apparatus 1 might not be able to perform printing on a desired position of the print medium 8.

In view of this situation or possibility, in the printing apparatus 1 of the present embodiment, the clutch 68 is allowed to be in the connected state in a state that the motor 77 is continuously rotating toward the one side. In this case, since the delay time and the through-up time as described above are not necessary, the printing apparatus 1 is capable of making the print position velocity Wp to be the predetermined velocity Vth at a desired timing. Accordingly, as depicted in FIG. 14C for example, even in a case that the print image G is to be printed on the print medium 8 with an interval T(3) which is further shorter than the interval T(2) in FIG. 14B, it is possible to accelerate the print position velocity Wp up to be equal to or more than the predetermined velocity Vth during the printing. Further, even in a case that the time since the detection of the print signal and until the print start timing is extremely short, the delay time and the through-up time as described above are not necessary. Accordingly, the print image G can be printed at a desired position of the print medium 8 with precision. In such a manner, the printing apparatus 1 is capable of controlling the print position velocity Wp of the print medium 8 with an excellent precision, and is capable of performing printing with a satisfactory print quality.

In a case that the printing operation for one block is ended (S29: YES), the printing apparatus 1 allows the clutch 68 to be in the disconnected state while maintaining the rotation of the motor 77 toward the one side (S31). In a case that the clutch 68 is allowed to be in the disconnected state, the driving force of the motor 77 is not transmitted to the movable body 71, and the movable body 71 starts the movement in the second direction. This allows the printing apparatus 1 to move the movable body 71 in the second direction toward the reference position during a period of time after the end of the printing operation for one block and until the start of a next printing operation.

After the printing operation for one block is completed (S29: YES), in a case that it is determined that the stopping instruction is received (S33: YES), the printing apparatus 1 stops the rotation of the shaft 77B of the motor 77 toward the one side (S35). In this case, since the printing apparatus 1 is capable of stopping the motor 77 in a state that the printing is stopped, it is possible to save the power in the apparatus.

In a case it is determined that the print signal has been received via the communication I/F 38 (S19: YES), the printing apparatus 1 stands by for the predetermined time (S21). After the predetermined time has elapsed, the printing apparatus 1 starts the printing operation for one block. After starting the printing operation for one block, the printing apparatus 1 determines whether the rotation amount of the platen roller 29 is equal to or less than the predetermined value Rth (S25). In this case, the printing apparatus 1 is capable of determining the rotation amount of the platen roller 29, in a state that the conveyance position velocity Wt in which the print medium 8 is being conveyed by the external apparatus 100 is stabilized and thus the rotation amount of the platen roller 29 is stabilized. Accordingly, the printing apparatus 1 is capable of appropriately determining and controlling the timing at which the clutch 68 is allowed to be in the connected state with the processing of step S27.

The printing apparatus 1 moves the movable body 71 by rotating the driving shaft 63 by the rotation driving force of the motor 77. The transmission device 6 has the clutch 68 interposed between the motor 77 and the driving shaft 63. The clutch 68 is switched between the connected state in which the rotation driving force of the motor 77 is transmitted to the driving shaft 63 and the disconnected state in which the rotation driving force of the motor 77 is not transmitted to the driving shaft 63. Namely, the printing apparatus 1 is capable of providing the state that the movable body 71 can be moved in the first direction by allowing the clutch 68 in the connected state, and of providing the state that the movable body 71 is freely movable by allowing the clutch 68 to be in the disconnected state. Accordingly, the printing apparatus 1 allows the clutch 68 to be in a disconnected state and allows the movable body 71 to be in a freely movable state, thereby making it possible to move the movable body 71 in the second direction by the force received from the print medium 8 (see FIG. 9C). Further, in a case that the clutch 68 is allowed to be in the disconnected state, the clutch 68 separates the driving shaft 63 from the element on the side of the motor 77. This makes it possible for the printing apparatus 1 to maximally suppress the resistance, which is generated in a case that the movable body 71 moves in the second direction by receiving the force from the print medium 8, by allowing the clutch 68 to be in the disconnected state. Therefore, the printing apparatus 1 is capable of using the force from the print medium 8 to thereby move the movable body 71 smoothly in the second direction.

The first sensor 41 is capable of detecting whether or not the movable body 71 is at the reference position. In a case that the signal outputted from the first sensor 41 is the ON signal, the printing apparatus 1 determines that the movable body 71 is located at the end part in the second direction of the movable range S, namely at the reference position (S15: YES). In this case, the printing apparatus 1 starts the printing operation for one block, and determines whether the rotation amount of the platen roller 29 is equal to or less than the predetermined value Rth (S25). Accordingly, the printing apparatus 1 is capable of determining whether the rotation amount of the platen roller 29 is equal to or less than the predetermined value Rth, in a state that the distance by which the movable body 71 is capable of moving in the first direction is maximally secured. Therefore, the printing apparatus 1 is capable of lessening such a possibility that the movable body 71 might move up to the end part in the first direction of the movable range S to thereby make it impossible to control the print position velocity Wp.

<Modifications>

The present disclosure is not limited to or restricted by the above-described embodiment, and various changes can be made to the present disclosure. The controller 31, the storing section 32, the operating section 36 and the connection I/F 39 may be provided, on the printing apparatus 1, as a control unit as a separate body from the casing 2A. In this case, a connection I/F may be provided also on the casing 2A, and may communicate with the connection I/F of the above-described control unit. Namely, a control unit which is separate from the cashing 2A may control the printing section 2 and the conveying section 7 via the connection I/F. Further, the communication I/F 38 configured to communicate with the external apparatus 100 may be provided on the conveying section 7.

In a case that the controller 31 performs the processing of step S25, the controller 31 may calculate the rotational velocity of the platen roller 29. The controller 31 may calculate the moving velocity at the position of the print medium 8 at which the print medium 8 makes contact with the platen roller 29, namely the print position velocity Wp, based on the calculated rotational velocity of the platen roller 29 and the diameter of the platen roller 29. The controller 31 may determine whether the calculated print position velocity Wp is equal to or less than the predetermined velocity Vth (S25). In a case that the controller 31 determines that the calculated print position velocity Wp is equal to or less than the predetermined velocity Vth (S25: YES), the controller 31 may allow the clutch 68 to be in the connected state (S27).

The transmission device 6 may rotate the platen roller 29 by transmitting the rotation driving force to the platen roller 29. In this case, the conveying section 7 preferably has a nip roller making contact with the platen roller 29. For example, as depicted in FIG. 9B, by rotating the platen roller 29 such that the print position velocity Wp becomes faster than the conveyance position velocity Wt, the movable body 71 which is held or pinched by the platen roller 29 and the nip roller can be moved in the first direction. On the other hand, for example, by rotating the platen roller 29 such that the print position velocity Wp becomes slower than the conveyance position velocity Wt, the movable body 71 can be moved in the second direction.

It is allowable that the controller 31 does not allow the clutch 68 to be in the disconnected state in step S31; instead, the controller 31 may output the driving-toward-other-side signal to the motor 77 to thereby rotate the shaft 77B toward the other side. Note that in a case of rotating the shaft 77B of the motor 77 toward the other side while maintaining the clutch 68 in the connected state, the movable body 71 moves in the second direction in accordance with the driving force of the motor 77. Accordingly, the printing apparatus 1 is capable of moving the movable body 71 in the second direction toward the reference position, while maintaining the clutch 68 in the connected stated.

After the printing operation for one block is ended (S29: YES), the controller 31 may decelerate the rotational velocity of the motor 77 down to a predetermined velocity at a same time at which the controller 31 allows the clutch 68 to be in the disconnected state. In a case that the printing operation for next one block is started (S19: YES), the controller 31 may accelerate the rotational velocity of the motor 77 from the predetermined velocity up to the original velocity.

In a case that the controller 31 determines that the controller 31 has received the print signal via the communication I/F 38 (S19: YES), the controller 31 may determine whether or not the rotation amount of the platen roller 29 is stabilized, based on the range of fluctuation (variation) of the rotation amount of the platen roller 29. After the controller 31 determines that the rotation amount of the platen roller 29 is stabilized, the controller 31 may determine whether the rotation amount of the platen roller 29 is equal to or less than the predetermined value Rth. Alternatively, in a case that the controller 31 determines that the controller 31 has received the print signal via the communication I/F 38 (S19: YES), the controller 31 may perform the determination regarding the rotation amount of the platen roller 29 immediately after the reception of the print signal (S25), without standing-by for the predetermined time.

The transmission device 6 transmits the rotation driving force of the motor 77 to the movable body 71 by rotating, with the driving shaft 63, the pinion gear 62 meshing with the rack gear 61. The transmission device 6 may have another configuration different from the above-described configuration. For example, the transmission device 6 may move the movable body 71 by rotating an annular belt, which is connected to the movable body 71, with a pulley connected to the driving shaft 63. It is allowable to provide a pinion gear (sprocket) instead of providing the first pulley 64 and the second pulley 65. In such a case, these two gears may mesh with each other, or an annular chain or a rack gear may be provided as a member connecting the two gears, instead of providing the belt.

In a case that a state that the signal outputted from the first sensor 41 is the ON signal is continued for a predetermined time (S15: YES), the controller 31 may determine that the movable body 71 is arranged at the reference position.

The rotary encoder 42A of the second sensor 42 in the above-described embodiment may be connected directly to the rotational shaft of the platen roller 29. The rotary encoder 42A may directly detect the rotation amount of the rotational shaft of the platen roller 29. Note that in this case, the rotating plate 42B possessed by the second sensor 42 in the above-described embodiment may be omitted.

The circumferential end part of the rotating plate 42B of the second sensor 42 may make contact with the circumferential surface of the guide roller 76. The rotary encoder 42A of the second sensor 42 may detect the rotation amount of the guide roller 76 by detecting the rotation amount of the shaft 422. Further, the rotary encoder 42A may be connected directly to any one of the shafts 761 to 766 of the guide roller 76. The rotary encoder 42A may directly detect the rotation amounts of the shafts 761 to 766 of the guide roller 76. Note that in this case, the rotating plate 42B possessed by the second sensor 42 in the above-described embodiment may be omitted.

<Miscellaneous>

The rotation axis 29X is an example of the "first axis" of the present teaching. The motor 77 is an example of the "AC motor" of the present teaching. The clutch 68 is an example of the "electromagnetic clutch" of the present teaching. The second sensor 42A of an example of the "sensor" of the present teaching. The first sensor 41 is an example of the "sensor" of the present teaching. The processing of step S11 is an example of the "starting step" of the present teaching. The processing of step S25 is an example of the "first determining step" of the present teaching. The processing of step S27 is an example of the "connecting step" of the present teaching. The rotation axis 63X of the driving shaft 63 is an example of the "second axis" of the present teaching. The CPU included in the controller 31 is an example of the "processor" of the present teaching.

What is claimed is:

1. A printing apparatus comprising:

a frame;

a platen roller configured to be rotated around a first axis;

a movable body supported by the frame to be movable in a first direction orthogonal to the first axis and a second direction opposite to the first direction, the movable body having:

a first roller positioned upstream of the platen roller in a conveyance path of a print medium and a second roller positioned downstream of the platen roller in the conveyance path, and a supporting member rotatably supporting the first roller and the second roller, the movable body being configured to shorten a part, of the conveyance path, between the platen roller and the first roller in accordance with movement of the movable body in the first direction, and to lengthen the part, of the conveyance path, between the platen roller and the first roller in accordance with movement of the movable body in the second direction;

an AC motor provided on the frame;

a transmission device provided on the frame and configured to transmit a driving force of the AC motor to the movable body and configured to move the movable body in the first direction in accordance with rotation of the AC motor toward one side, the transmission device including at least an electromagnetic clutch, the transmission device being configured to transmit the driving force to the movable body in a case that the electromagnetic clutch is in a connected state, and configured not to transmit the driving force to the movable body in a case that the electromagnetic clutch is in a disconnected state;

an encoder configured to output a rotation signal in accordance with a rotation amount of the platen roller;

a communication interface configured to communicate with an external apparatus and to receive a print signal indicating a position of the print medium; and a controller configured to:

start the rotation of the AC motor toward the one side regardless of the rotation signal outputted from the encoder and the print signal received via the communication interface, determine whether the rotation amount of the platen roller in accordance with the rotation signal outputted from the encoder is equal to or less than a predetermined value, after starting the rotation of the AC motor toward the one side, and allow the electromagnetic clutch to be in the connected state, under a condition that the controller determines that the rotation amount is equal to or less than the predetermined value.

2. The printing apparatus according to claim 1, wherein the controller is further configured to allow the electromagnetic clutch to be in the disconnected state, in response to end of printing which is performed in accordance with the print signal received via the communication interface, while maintaining the rotation of the AC motor toward the one side.

3. The printing apparatus according to claim 1, wherein the controller is further configured to stop the rotation of the AC motor toward the one side, in response to receipt of a stopping instruction for stopping a printing operation by the printing apparatus.

4. The printing apparatus according to claim 1, wherein the controller is configured to determine whether the rotation amount of the platen roller is equal to or less than the predetermined value after elapse of a predetermined time since receipt of the print signal via the communication interface.

5. The printing apparatus according to claim 1, wherein the transmission device has:

a rack gear provided on the supporting member, a pinion gear configured to mesh with the rack gear, a driving shaft connected to the pinion gear and rotatably supported by the frame, the driving shaft being configured to rotate about a second axis parallel to the first axis, in accordance with the driving force of the AC motor, and a gear or a pulley which is provided coaxially with the driving shaft and to which the driving force of the AC motor is transmitted;

wherein the electromagnetic clutch has an element to which the driving shaft is fixed, and another element to which the gear or the pulley is fixed; and the electromagnetic clutch is configured such that the driving force is transmitted between the element and the other element when the electromagnetic clutch is in the connected state, and the driving force is not transmitted between the element and the other element when the electromagnetic clutch is in the disconnected state.

6. The printing apparatus according to claim 1, further comprising a sensor configured to detect a position of the movable body and to output a signal in accordance with the detected position, wherein the controller is configured to further determine whether the movable body is positioned at an end part in the second direction of a moving range of the movable body, based on the signal outputted from the sensor; and the controller is configured to determine whether the rotation amount of the platen roller is equal to or less than the predetermined value, after the controller determines that the movable body is positioned at the end part in the second direction of the moving range.

7. A printing method comprising:

a starting step of starting rotation of an AC motor toward one side;

a first determining step of determining whether a rotation amount of a platen roller is equal to or less than a predetermined value, after starting the rotation of the AC motor toward the one side by the starting step; and a connecting step of connecting, in a case that the rotation amount is determined to be equal to or less than the predetermined value by the first determining step, an electromagnetic clutch which is included in a transmission device configured to transmit a driving force from the AC motor, to thereby move a movable body in a first direction by the driving force which is generated by the rotation of the AC motor toward the one side and which is transmitted to the movable body via the transmission device, and to accelerate a print medium at a position of the platen roller.

8. A non-transitory computer-readable medium storing computer-executable instructions which, when executed by a processor of a printing apparatus, cause the printing apparatus to execute:

a starting step of starting rotation of an AC motor toward one side, the AC motor driving a movable body via a transmission device, the movable body being configured to accelerate a print medium at a position of a platen roller in accordance with movement of the movable body in a first direction;

a first determining step of determining, after starting the rotation of the AC motor toward the one side by the starting step, whether a rotation amount of the platen roller is equal to or less than a predetermined value, based on a rotation signal which is outputted from an encoder in accordance with the rotation amount of the platen roller; and a connecting step of allowing, in a case that the rotation amount is determined to be equal to or less than the predetermined value by the first determining step, an electromagnetic clutch included in the transmission device to be in a connected state, wherein in a case that the electromagnetic clutch is allowed to be in a connected state, a driving force which is generated by the rotation of the AC motor toward the one side is transmitted to the movable body to thereby move the movable body in the first direction; and in a case that the electromagnetic clutch is allowed to be in a disconnected state, the driving force which is generated by the rotation of the AC motor toward the one side is not transmitted to the movable body and the movable body does not move in the first direction.

* * * * *